US012241479B2

(12) United States Patent
Zhang et al.

(10) Patent No.: US 12,241,479 B2
(45) Date of Patent: Mar. 4, 2025

(54) DIFFUSER, AIR SUPPLY DEVICE, AND VACUUM CLEANING EQUIPMENT

(71) Applicant: GUANGDONG WELLING MOTOR MANUFACTURING CO., LTD., Guangdong (CN)

(72) Inventors: Wei Zhang, Guangdong (CN); Tingting Jiang, Guangdong (CN); Yayun Zhou, Guangdong (CN); Fan Yang, Guangdong (CN); Zhuo Lv, Guangdong (CN)

(73) Assignee: GUANGDONG WELLING MOTOR MANUFACTURING CO., LTD., Guangdong (CN)

( * ) Notice: Subject to any disclaimer, the term of this patent is extended or adjusted under 35 U.S.C. 154(b) by 36 days.

(21) Appl. No.: 17/829,872

(22) Filed: Jun. 1, 2022

(65) Prior Publication Data

US 2022/0290689 A1 Sep. 15, 2022

Related U.S. Application Data

(63) Continuation of application No. PCT/CN2020/137650, filed on Dec. 18, 2020.

(30) Foreign Application Priority Data

Jan. 6, 2020 (CN) ..... 202010010950.8
Jan. 6, 2020 (CN) ..... 202010010952.7
Jan. 6, 2020 (CN) ..... 202010011558.5

(51) Int. Cl.
*F04D 29/44* (2006.01)
*A47L 5/22* (2006.01)

(52) U.S. Cl.
CPC ..... *F04D 29/441* (2013.01); *A47L 5/22* (2013.01)

(58) Field of Classification Search
CPC ..... F04D 29/44–444; F05D 2240/12; F05D 2250/38
See application file for complete search history.

(56) References Cited

U.S. PATENT DOCUMENTS 2,798,661 A * 7/1957 Willenbrock, Jr. ..... F02C 7/04 415/209.1
3,173,604 A * 3/1965 Sheets ..... F01D 5/146 415/209.1

(Continued)

FOREIGN PATENT DOCUMENTS

CA 2700517 A1 4/2009
CN 2209231 Y 10/1995

(Continued)

OTHER PUBLICATIONS

Extended European Search Report dated Nov. 17, 2022 received in European Patent Application No. EP 20911796.9.

(Continued)

*Primary Examiner* — Brian P Wolcott
(74) *Attorney, Agent, or Firm* — Scully, Scott, Murphy & Presser, P.C.

(57) ABSTRACT

A diffuser, an air supply device and a vacuum cleaning equipment are provided. The diffuser has a base ring member and multiple rows of stationary blades. Each row of stationary blades is disposed on an outer ring wall of the base ring member along an axial direction of the base ring member, and is arranged along a circumferential direction of the base ring member. Opposite sides of the base ring member are respectively an air-inlet side and an air-outlet side. A chord length of each stationary blade in one row is greater than or equal to the chord length of each stationary blade in a next adjacent row. The installation angle of each stationary blade in one row is smaller than or equal to the (Continued)

installation angle of each stationary blade in the next adjacent row.

8 Claims, 11 Drawing Sheets

(56) References Cited

U.S. PATENT DOCUMENTS

| | | | | |
|---|---|---|---|---|
| 3,861,826 | A | 1/1975 | Dean | |
| 4,946,348 | A * | 8/1990 | Yapp | F04D 29/5826 415/211.2 |
| 4,981,414 | A * | 1/1991 | Sheets | F04D 29/68 415/149.1 |
| 5,152,661 | A * | 10/1992 | Sheets | F04D 29/544 415/208.4 |
| 5,743,710 | A | 4/1998 | Yapp | |
| 10,641,282 | B2 * | 5/2020 | Hayamitsu | F04D 29/384 |
| 11,073,163 | B2 | 7/2021 | Saito | |
| 11,473,594 | B2 * | 10/2022 | Johnson | F04D 25/0606 |
| 2018/0180050 | A1 * | 6/2018 | Hayamitsu | F04D 29/083 |
| 2018/0335039 | A1 * | 11/2018 | Hayamitsu | A47L 5/24 |

FOREIGN PATENT DOCUMENTS

| | | | |
|---|---|---|---|
| CN | 101868630 | A | 10/2010 |
| CN | 102654140 | A | 9/2012 |
| CN | 102803740 | A | 11/2012 |
| CN | 103557156 | A | 2/2014 |
| CN | 103889295 | A | 6/2014 |
| CN | 104350286 | A | 2/2015 |
| CN | 105221243 | A | 1/2016 |
| CN | 105874211 | A | 8/2016 |
| CN | 106089807 | A | 11/2016 |
| CN | 106460537 | A | 2/2017 |
| CN | 106640768 | A | 5/2017 |
| CN | 206636838 | U | 11/2017 |
| CN | 107532609 | A | 1/2018 |
| CN | 207568931 | U | 7/2018 |
| CN | 207598541 | U | 7/2018 |
| CN | 108644152 | A | 10/2018 |
| CN | 108953229 | A | 12/2018 |
| CN | 109083868 | A | 12/2018 |
| CN | 208634069 | U | 3/2019 |
| CN | 110513304 | A | 11/2019 |
| CN | 211666920 | U | 10/2020 |
| CN | 212079745 | U | 12/2020 |
| EP | 1873402 | A1 | 1/2008 |
| EP | 2628958 | A2 | 8/2013 |
| JP | H04505199 | A | 9/1992 |
| JP | H06307392 | A | 11/1994 |
| JP | H11173296 | A | 6/1999 |
| JP | H11257290 | A | 9/1999 |
| RU | 2402695 | C1 | 10/2010 |
| WO | 2016083382 | A1 | 6/2016 |
| WO | 2018181343 | A1 | 10/2018 |
| WO | 2019220071 | A1 | 11/2019 |

OTHER PUBLICATIONS

Second Office Action dated Mar. 9, 2022 received in Chinese Patent Application No. CN 202010010950.8.
Decision of Rejection dated May 30, 2022 received in Chinese Patent Application No. CN 202010010952.7.
First Office Action dated Nov. 16, 2021 received in Chinese Patent Application No. CN 202010010952.7.
First Office Action dated Nov. 1, 2021 received in Chinese Patent Application No. CN 202010010950.8.
First Office Action dated Nov. 2, 2021 received in Chinese Patent Application No. CN 202010011558.5.
International Search report dated Mar. 17, 2021 received in International Application No. PCT/CN2020/137650.
Notification to Grant Patent Right for Invention dated Sep. 21, 2022 received in Chinese Patent Application No. CN 202010010952.7.
Notice of Reasons for Refusal dated Apr. 18, 2023 received in Japanese Patent Application No. JP 2022-529913.
Notification to Grant Patent Right for Invention dated Apr. 25, 2022 received in Chinese Patent Application No. CN 202010010950.8.
Second Office Action dated Feb. 16, 2022 received in Chinese Patent Application No. CN 202010010952.7.
Second Office Action dated Mar. 9, 2022 received in Chinese Patent Application No. CN 202010011558.5.
Notification to Grant Patent Right for Invention dated Apr. 20, 2022 received in Chinese Patent Application No. CN 202010011558.5.
Office Action dated Mar. 14, 2024 received in Vietnamese Patent Application No. VN 1-2022-03716.
Notice of Reasons for Refusal dated Feb. 6, 2024 received in Japanese Patent Application No. JP 2023-106405.
Notice of Issuance of Opinion System dated Jan. 31, 2024 received in Korean Patent Application No. KR 10-2022-7016870.
Notice of Reasons for Refusal dated Feb. 6, 2024 received in Japanese Patent Application No. JP 2023-106404.
International Preliminary Report on Patentability Chapter I, Mar. 12, 2021. 11 pages.
Notice of Reasons for Refusal dated Jun. 11, 2024 received in Japanese Patent Application No. 2023-106405.
Patent Assessment dated Jun. 11, 2024 received in Japanese Patent Application No. 2023-106404.
Notice of Final Rejection dated Oct. 25, 2024 received in Korean Patent Application No. 10-2022-7016870.

* cited by examiner

DIFFUSER, AIR SUPPLY DEVICE, AND VACUUM CLEANING EQUIPMENT

CROSS-REFERENCE TO RELATED APPLICATIONS

This application is a continuation application of PCT International Application No. PCT/CN2020/137650 filed on Dec. 18, 2020, which claims the priority to and benefits of Chinese Patent Application No. 202010010952.7 filed on Jan. 6, 2020; Chinese Patent Application No. 202010010950.8 filed on Jan. 6, 2020; and Chinese Patent Application No. 202010011558.5, filed on Jan. 6, 2020. The entire contents of the above applications are incorporated herein by reference for all purposes. No new matter has been introduced.

FIELD

The present application relates to the field of cleaning equipment, and in particular, to a diffuser, an air supply device and a vacuum cleaning equipment.

BACKGROUND

The vacuum cleaning equipment is usually equipped with an air supply device, and in the air supply device, a diffuser is installed to convert the kinetic energy of the airflow flowing through the air supply device into pressure energy, thereby reducing the flow loss of the airflow. The diffuser is usually provided with stationary blades to divert and pressurize the airflow.

However, the existing layouts of stationary blades still cannot fully realize the conversion between the kinetic energy and pressure energy of the airflow when flowing through the diffuser, which results in a significant flow loss when the airflow flows through the diffuser.

SUMMARY

An object of the exemplary embodiments in the present application is to at least provide a diffuser, which aims to solve at least the technical problem in the existing technologies that the flow loss of the airflow when passing through the diffuser is relatively large.

To achieve the above object, exemplary embodiments provided by the present application may include the following aspects.

In accordance with a first aspect of the disclosure, a diffuser is provided, which includes a base ring member and multiple rows of stationary blades. Each row of the stationary blades is disposed in sequence on an outer ring wall of the base ring member along an axial direction of the base ring member, and are arranged along a circumferential direction of the base ring member. Opposite sides of the base ring member along the axial direction of the base ring member are respectively an air-inlet side and an air-outlet side. From the air-inlet side to the air-outlet side, a chord length of each stationary blade in one row is greater than or equal to the chord length of each stationary blade in a next adjacent row. The stationary blade has an installation angle, and from the air-inlet side to the air-outlet side, the installation angle each stationary blade in one row is smaller than or equal to the installation angle of each stationary blade in the next adjacent.

In accordance with a second aspect of the disclosure, a diffuser is provided, which includes a base ring member and a plurality of stationary blades. The plurality of stationary blades are arranged in multiple rows along an axial direction of the base ring member in sequence, and each row has multiple stationary blades. The multiple stationary blades in each row are arranged along a circumferential direction of the base ring member. The base ring member has a circular cross-section. Profiles of each stationary blade in at least one row of the multiple rows of stationary blades are inclined toward a side of the stationary blade.

In accordance with a third aspect of the disclosure, a diffuser is provided, which includes a base ring member and a plurality of stationary blades. The plurality of stationary blades are arranged in multiple rows along an axial direction of the base ring member in sequence, and each row has multiple stationary blades. The multiple stationary blades in each row are arranged along a circumferential direction of the base ring member. The base ring member has a circular cross-section. A thickness of each stationary blade in at least one row of the multiple rows of stationary blades is in a non-constant setting from a head to a tail of the stationary blade.

In accordance with a fourth aspect of the disclosure, an air supply device is provided, which includes the above-mentioned diffuser.

In accordance with a fifth aspect of the disclosure, a vacuum cleaning equipment is provided, which includes the above air supply device.

Embodiments of the present application have at least the following beneficial effects: in the diffuser provided in the present application, multiple rows of stationary blades are arranged in the diffuser along the axial direction of the base ring member, in such a way the airflow flowing through the diffuser can obtain a multi-stage diversion effect of each row of stationary blades, such that the multi-stage deceleration and diffusion of the airflow is realized, and thus the flow loss of the airflow when flowing through the diffuser is reduced.

The air supply device provided in the present application includes the above-mentioned diffuser. The above-mentioned diffuser can ensure a smooth deceleration and diffusion of the airflow when the airflow flows through the diffuser without a large flow loss. In this way, the overall working efficiency of the air supply device can also be improved, and thus the working energy consumption of the air supply device is saved.

The vacuum cleaning equipment provided in the present application includes the above-mentioned air supply device. The above-mentioned air supply device can achieve a smooth deceleration and diffusion of the airflow, save energy and protect environment during operation. In this way, the vacuuming effect of the vacuum cleaning equipment including the air supply device is significantly improved, and the working energy consumption of the vacuum cleaning equipment is also saved.

BRIEF DESCRIPTION OF THE DRAWINGS

In order to illustrate the solutions in the present application more clearly, the following briefly introduces the drawings that need to be used in the description of the embodiments or the existing technologies. Obviously, the drawings in the following description are merely some examples of the present application. For those of ordinary skill in the art, other drawings can also be obtained according to these drawings without creative labor.

Figure 1:
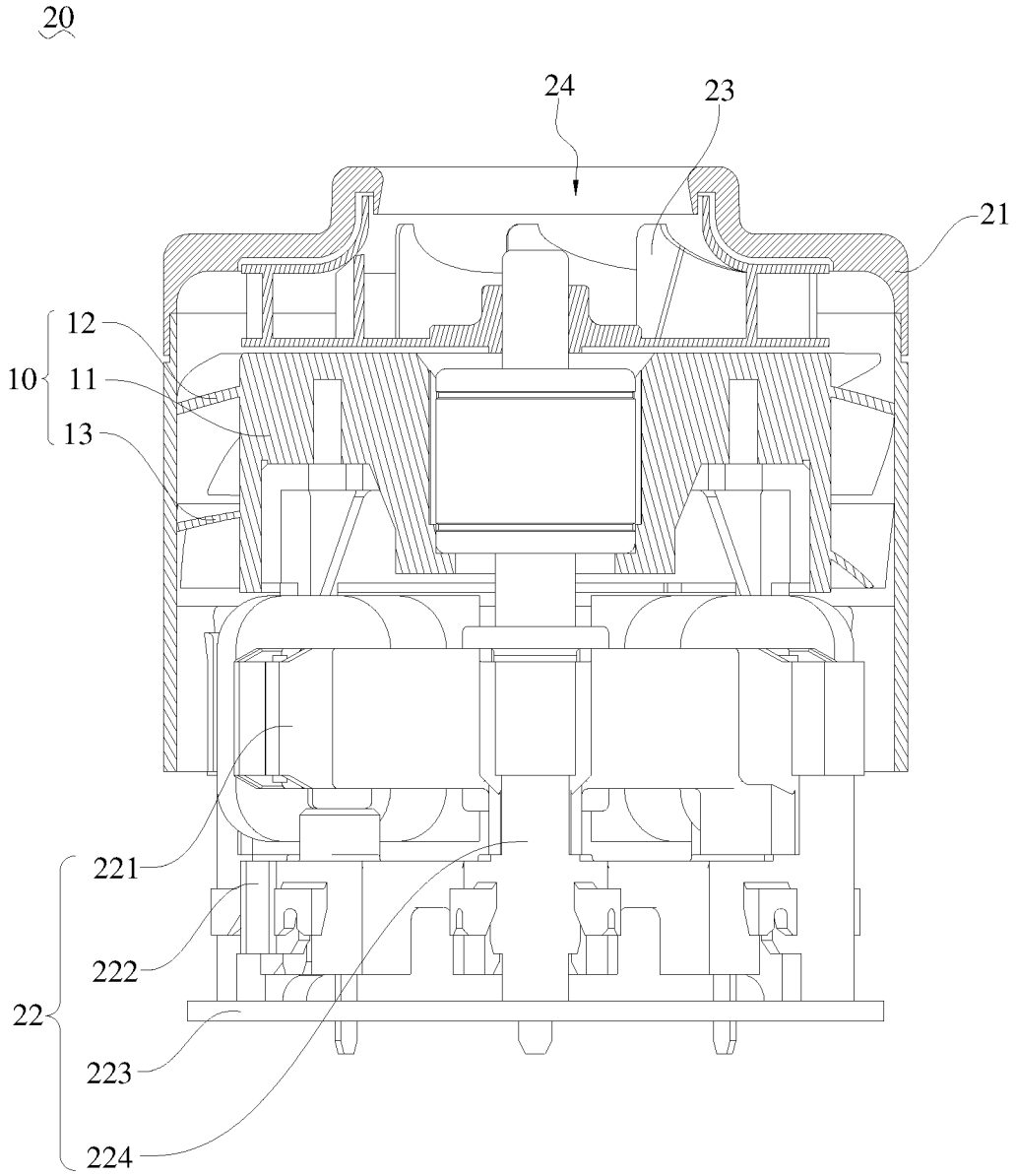
FIG. 1 is a schematic structural diagram of an air supply device in accordance with an embodiment.

Reference numerals in the figures are listed as follows:

10—diffuser; 11—base ring member; 12—first row of stationary blades; 13—second row of stationary blades; 14—pressure surface; 15—flow channel; 16—blade tip; 17—blade root; 18—profiles; 19—suction surface; 20—air supply device; 21—fan cover; 22—drive mechanism; 23—impeller; 24—air inlet; 111—outer ring wall; 112—inner ring wall; 113—installation hole; 114—stationary blade; 221—frame; 222—motor; 223—circuit substrate; 224—drive shaft; and 225—bearing.

DETAILED DESCRIPTION OF EMBODIMENTS

Embodiments of the present application are described in detail below, examples of the embodiments are illustrated in the drawings, in which the same or similar reference numerals refer to the same or similar elements or elements having the same or similar functions. The embodiments described below with reference to FIGS. 1 to 16 are exemplary, intended to explain the present application, and should not be construed as limitations on the present application.

In the description of the present application, it should be understood that the orientation or positional relationship indicated by terms "length", "width", "upper", "lower", "front", "rear", "left", "right", "vertical", "horizontal", "top", "bottom", "inside", "outside", etc. is based on the orientation or positional relationship shown in the drawings, which is only for the convenience of describing the present application and simplifying the description, rather than indicating or implying that the device or element referred to must have, be constructed, or operate in a particular orientation, and thus should not be construed as a limitation on the present application.

In addition, the terms "first" and "second" are only used for descriptive purpose, and should not be construed as indicating or implying relative importance or implying the number of indicated technical features. Thus, a feature defined with "first" or "second" may expressly or implicitly include one or more of that features. In the description of the present application, the term "multiple" means two or more, unless otherwise expressly and specifically defined.

In the present application, unless otherwise expressly specified or limited, the terms "installed", "connected", "coupled", "fixed" and other terms should be understood in a broad sense, for example, it may be a fixed connection or a detachable connection, or an integrated connection; it may be a mechanical connection or an electrical connection; it may be a direct connection or an indirect connection through an intermediate medium, and it may be an internal connection of two elements or an interaction relationship between the two elements. For those of ordinary skill in the art, specific meanings of the above terms in the present application can be understood according to specific circumstances.

Figure 2:
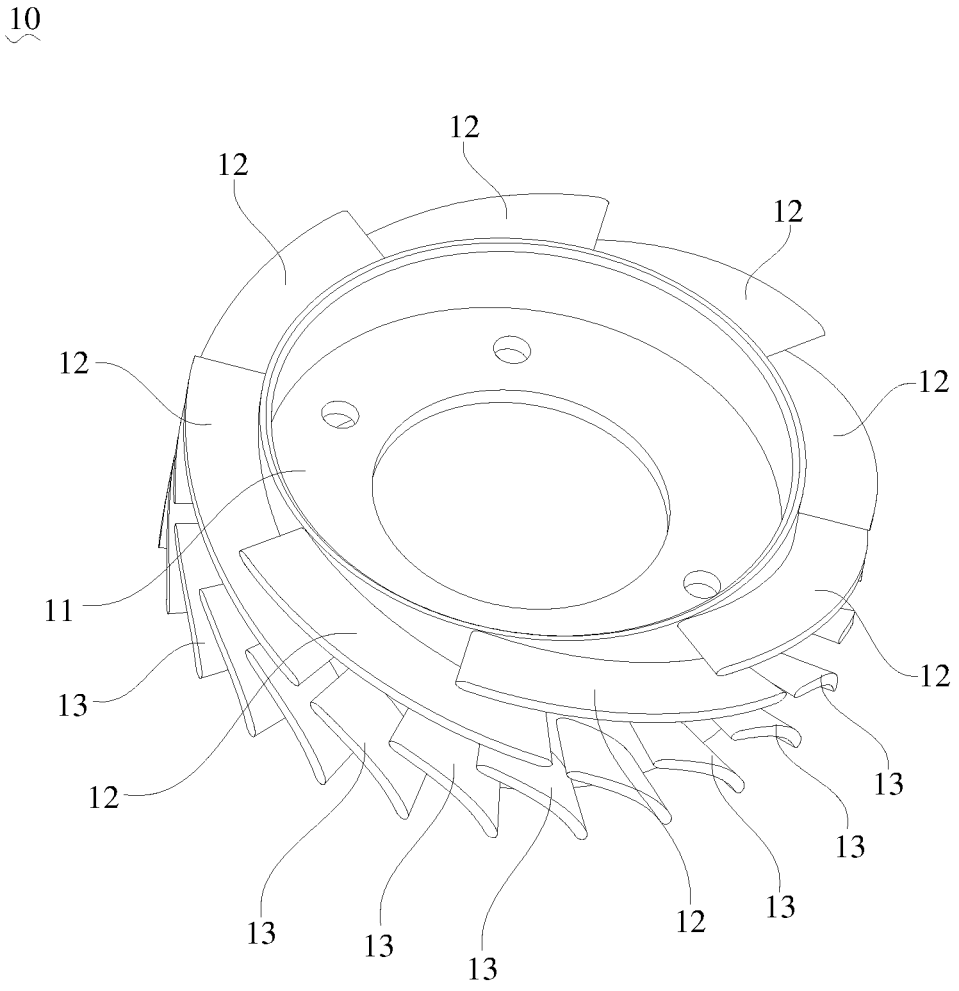
FIG. 2 is a schematic structural diagram of a diffuser of the air supply device in accordance with an embodiment.
Figure 4:
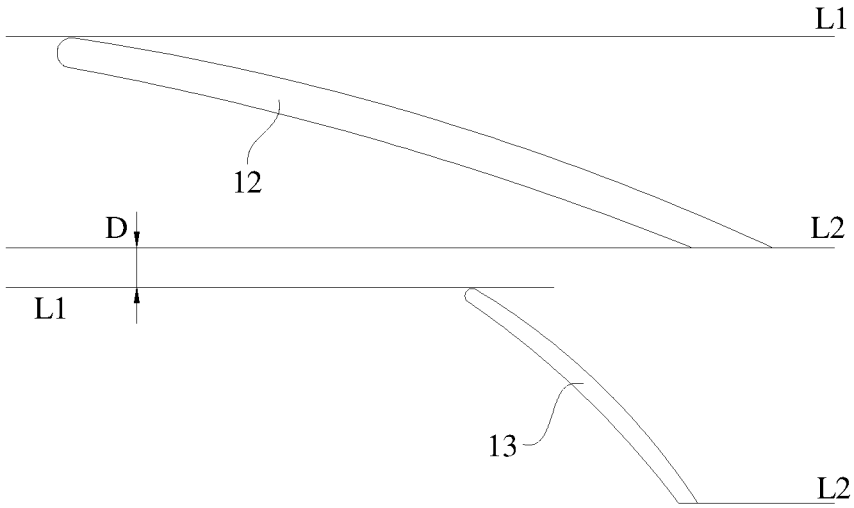
FIG. 4 is a cascade diagram of the first and second rows of stationary blades of the diffuser of the air supply device in accordance with an embodiment.
Figure 5:
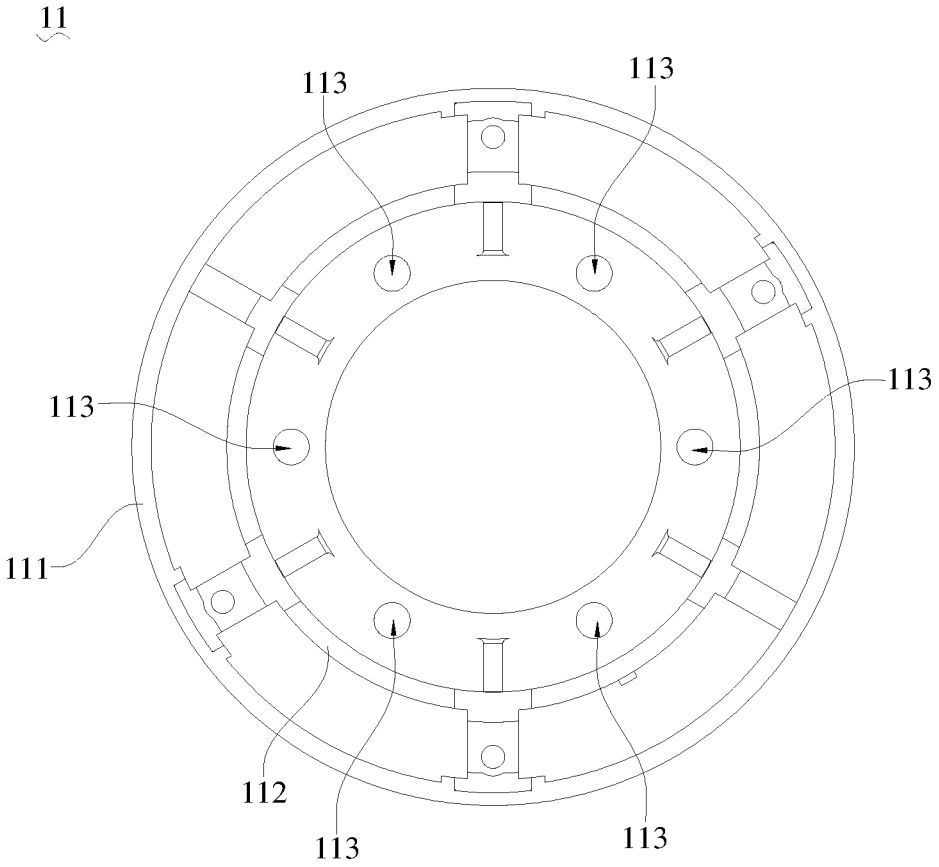
FIG. 5 is a schematic structural diagram of a base ring member of the diffuser of the air supply device in accordance with an embodiment.

As shown in FIG. 1, FIG. 2 and FIG. 4, in one exemplary embodiment of the disclosure, a diffuser 10 is provided for an air supply device 20. The air supply device 20 may be used for, but not limited to, a vacuum cleaning equipment. As shown in FIG. 5, the diffuser 10 includes a base ring member 11 and several rows of stationary blades 114. Each row of stationary blades 114 is disposed in sequence on an outer ring wall 111 of the base ring member 11 along the axial direction of the base ring member 11, and the stationary blades are distributed along the circumferential direction of the base ring member 11. Opposite sides of the base ring member 11 along the axial direction are defined as an air-inlet side and an air-outlet side respectively, and the base ring member 11 has an outer ring wall 111 and an inner ring wall 112. The inner ring wall 112 is defined with a number of installation holes 113. A fixed connection of the base ring member 11 in the diffuser 10 can be realized by means of locking bolts passing through the installation holes 113 and a frame 221. From the air-inlet side to the air-outlet side, a chord length of each stationary blade 114 in one row is greater than or equal to the chord length of each stationary blade 114 in the next adjacent row. The stationary blades 114 have installation angles, and from the air-inlet side to the air-outlet side, an installation angle of each stationary blade 114 in one row is smaller than or equal to the installation angle of each stationary blade 114 in the next adjacent row.

Figure 3:
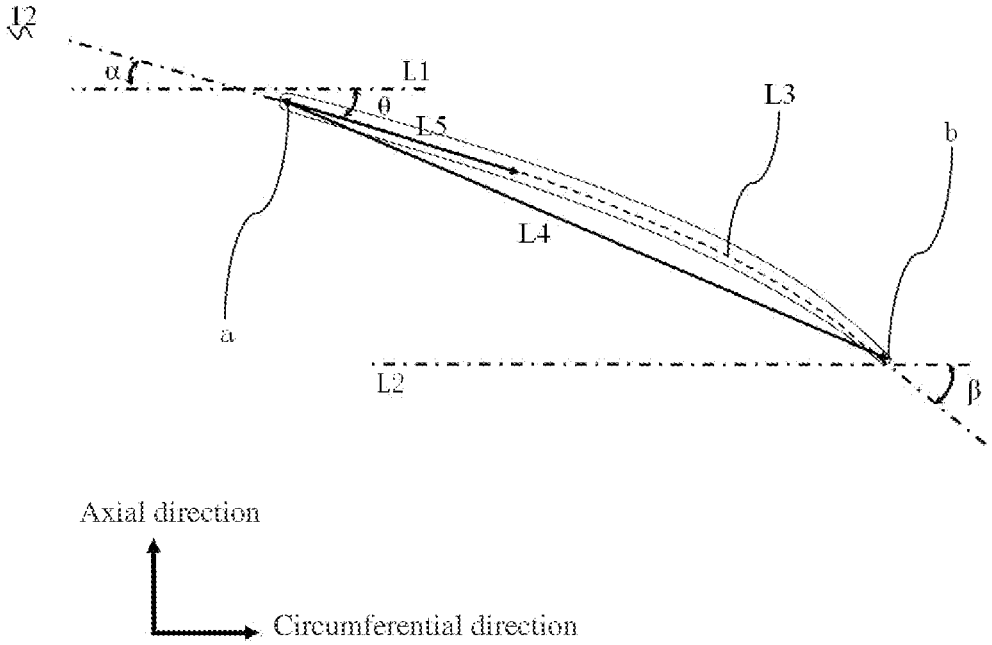
FIG. 3 is a cascade diagram of a first row of stationary blades of the diffuser of the air supply device in accordance with an embodiment.

Firstly, some terms involved in this exemplary embodiment are explained with reference to FIG. 3 as follows:

Forehead line: a line formed by connecting the corresponding points at the heads of the stationary blades 114 in the same row is called a forehead line (shown as L1 in FIG. 3);

Posterior forehead line: a line formed by connecting the corresponding points at the tails of the stationary blades 114 in the same row is called a posterior forehead line (shown as L2 in FIG. 3);

Inlet placement angle: an included angle formed by the tangent lines of the center-line and the forehead line at the head of the stationary blade (shown as a in FIG. 3);

Outlet placement angle: an included angle formed by the tangent lines of the center-line and the posterior forehead line at the tail of the stationary blade (shown as β in FIG. 3);

Installation angle: an included angle between the forehead line and the chord length of the stationary blade 114, which varies in accordance with the chord length (shown as β in FIG. 3);

Head of the stationary blade 114: along the axial direction of the base ring member 11, the front-most position of the stationary blade 114 is the head (shown as a in FIG. 3);

Tail of the stationary blade 114: along the axial direction of the base ring member 11, the last position of the stationary blade 114 is the tail (shown as b in FIG. 3);

Height of the stationary blade 114: a length of the stationary blade 114 in the radial direction of the base ring member 11;

blade tip: a position at the top where the stationary blade 114 increases to along the radial direction of the base ring member is the blade tip;

Chord length: a straight-line distance from the head to the tail of the stationary blade 114 along a center-line is the chord length (shown as L4 in FIG. 3);

Center-line: a curve formed by connecting the center points in the thickness direction of the stationary blade 114 from the head to the tail of the stationary blade 114 is called a center-line (shown as L3 in FIG. 3).

In the diffuser of this embodiment, multiple rows of stationary blades 114 are arranged in the diffuser along the axial direction of the base ring member, so that the airflow flowing through the diffuser can obtain a multi-stage diversion effect from each row of the stationary blades 114. In this way, the multi-stage deceleration and diffusion of the airflow is realized, and thus the flow loss of the airflow when flowing through the diffuser is reduced.

The following will further describe the diffuser 10 provided in this embodiment. In the diffuser 10 of this embodiment, multiple rows of stationary blades 114 are arranged along the axial direction of the base ring member 11 in the diffuser 10, so that the airflow flowing through the diffuser 10 can obtain the multi-stage diversion effect from each row of the stationary blades 114, in such a way, the multi-stage deceleration and diffusion of the air flow is realized first. The chord length of each stationary blade 114 in one row is greater than or equal to the chord length of each stationary blade 114 in the next adjacent row, from the air-inlet side to the air-outlet side of the base ring member 11. In this way, the flow separation phenomenon caused by the airflow can be gradually weakened through each row of stationary blades 114, and thus the flow loss generated when the airflow passes through the diffuser 10 can be significantly reduced. In this way, the airflow, due to the diversion effect from each row of stationary blades 114, can be smoothly decelerated and diffused without large flow loss.

In this embodiment, the head of the stationary blade 114 has an inlet placement angle, and from the air-inlet side to the air-outlet side, the inlet placement angle of each stationary blade 114 in one row is smaller than or equal to the inlet placement angle of each stationary blade 114 in the next adjacent row. An outlet placement angle of each stationary blade 114 in one row is smaller than or equal to the outlet placement angle of each stationary blade 114 in the next adjacent row.

For example, by arranging the inlet placement angle of each stationary blade 114 in one row to be smaller than or equal to that in the next adjacent row, and arranging the outlet placement angle of each stationary blade 114 in one row to be smaller than or equal to that in the next adjacent row, the non-uniformity of the airflow can be effectively suppressed when the airflow flows from the previous row of stationary blades 114 to the next row of stationary blades 114; meanwhile, the flow separation phenomenon generated when the airflow flows from the previous row of stationary blades 114 to the next row of stationary blades 114 can also be effectively suppressed. Thus, the flow loss when the airflow flows from the previous row of stationary blades 114 to the next row of stationary blades 114 can be effectively reduced, thereby improving the flow efficiency of the airflow.

In this embodiment, the tail of the stationary blade 114 has an outlet placement angle, and from the air-inlet side to the air-outlet side, the outlet placement angle of each stationary blade 114 in one row may be smaller than or equal to the inlet placement angle of each stationary blade 114 in the next adjacent row, such that the airflow can smoothly flow from the previous row of stationary blades 114 to the next row of stationary blades 114. In this embodiment, the outlet placement angle of each stationary blade 114 in one row may also be larger than the inlet placement angle of each stationary blade 114 in the next adjacent row.

In this embodiment, as shown in FIG. 2, the diffuser 10 may include a first row of stationary blades 12 and a second row of stationary blades 13. The first and second rows of stationary blades 13 are disposed on the outer ring wall 111 of the base ring member 11 along the axial direction of the base ring member 11 in sequence from the air-inlet side to the air-outlet side. For example, two rows of the stationary blades 114 are provided, which on the one hand ensures that the number of stationary blades 114 is sufficient to fully drain and diffuse the airflow, and on the other hand ensures that the number of rows of the stationary blades 114 is not too much, which in turn achieves a compact design of the diffuser 10.

In this embodiment, the angle value of the inlet placement angle of each stationary blade in the first row of stationary blades 12 may range from 5° to 20°, and the angle value of the inlet placement angle of each stationary blade in the second row of stationary blades 13 may range from 20° to 40°. For example, the angle value of the inlet placement angle of each stationary blade in the first row 12 may be 5°, 5.5°, 6°, 6.5°, 7°, 7.5°, 8°, 8.5°, 9°, 9.5°, 10°, 10.5°, 11°, 11.5°, 12°, 12.5°, 13°, 13.5°, 14°, 14.5°, 15°, 15.5°, 16°, 16.5°, 17°, 17.5°, 18°, 18.5°, 19°, 19.5° or 20°.

The angle value of the inlet placement angle of each stationary blade in the second row of stationary blades 13 may be 20°, 20.5°, 21°, 21.5°, 22°, 22.5°, 23°, 23.5°, 24°, 24.5°, 25°, 25.5°, 26°, 26.5°, 27°, 27.5°, 28°, 28.5°, 29°, 29.5°, 30°, 30.5°, 31°, 31.5°, 32°, 32.5°, 33°, 33.5°, 34°, 34.5, 35°, 35.5°, 36°, 36.5°, 37°, 37.5°, 38°, 38.5°, 39°, 39.5° or 40°.

The angle value of the inlet placement angle of each stationary blade in the first row of stationary blades 12 ranges from 5° to 20°, and the angle value of the inlet placement angle of each stationary blade in the second row of stationary blades 13 ranges from 20° to 40°, so that an effective suppression of the flow non-uniformity when the airflow passes through the stationary blades in the first and second rows 12, 13 can be realized, and also the effective diversion of the airflow by the second row of stationary blades 13 can be ensured.

In this embodiment, the angle value of the outlet placement angle of each stationary blade in the first row of stationary blades 12 may range from 10° to 60°, and the angle value of the inlet placement angle of each stationary blade in the second row of stationary blades 13 may range from 60° to 80°. For example, the angle value of the outlet placement angle of each stationary blade in the first row of stationary blades 12 may be 10°, 15°, 20°, 25°, 30°, 35°, 40°, 45°, 50°, 55° or 60°. The angle value of the inlet placement angle of each stationary blade in the second row 13 may be 60°, 61°, 62°, 63°, 64°, 65°, 66°, 67°, 68°, 69°, 70°, 71°, 72°, 73°, 74°, 75°, 76°, 77°, 78°, 79° or 80°.

The angle value of the outlet placement angle of each stationary blade in the first row of stationary blades 12 ranges from 10° to 60°, and the angle value of the inlet placement angle of each stationary blade in the second row of stationary blades 13 ranges from 60° to 80°, so that an effective suppression of the flow separation phenomenon generated when the airflow flows from the first row of stationary blades 12 to the second row of stationary blades 13 can be realized, the flow state of the airflow can be optimized, and also the flow loss generated when the airflow flows from the first row of stationary blades 12 to the second row of stationary blades 13 can be reduced, and thus the flow efficiency of the airflow is improved.

In this embodiment, a ratio of the chord length of each stationary blade in the first row of stationary blades 12 to the chord length of each stationary blade in the second row of stationary blades 13 may be greater than or equal to 1 and smaller than or equal to 5. For example, the ratio of the chord length of each stationary blade in the first row of stationary blades 12 to the chord length of each stationary blade in the second row of stationary blades 13 may be 1, 1.2, 1.5, 1.7, 2, 2.2, 2.5, 2.7, 3, 3, 3.2, 3.5, 3.7, 4, 4.2, 4.5, 4.7 or 5. The ratio of the chord length of each stationary blade in the first row of stationary blades 12 to the chord length of each stationary blade in the second row of stationary blades 13 is greater than or equal to 1 and smaller than or equal to 5, such that the flow separation phenomenon generated when the airflow from the first row of stationary blades 12 to the second row of stationary blades 13 can be further weakened, and thus the flow loss generated when the airflow passes through the diffuser 10 can be further reduced.

In this embodiment, the number of stationary blades in the first row of stationary blades 12 may be smaller than or equal to the number of stationary blades in the second row of stationary blades 13. The stationary blades in the first row of stationary blades 12 and in the second row of stationary blades 13 are respectively distributed uniformly along the circumferential direction of the outer ring wall. The first row of stationary blades 12 and the second row of stationary blades 13 are distributed in mutual dislocation in the axial direction of the outer ring wall, and at least the head or tail of one stationary blade 114 in the first row of stationary blades 12 is aligned with the head or tail of one stationary blade 114 in the second row of stationary blades 13 in the axial direction of the outer ring wall. In this way, the connection between the first row of stationary blades 12 and the second row of stationary blades of stationary blades 13 is stronger, thereby facilitating the efficient flow of air from the first row of stationary blades 12 to the second row of stationary blades of stationary blades 13.

In this embodiment, the number of stationary blades in the first row of stationary blades 12 may range from 6 to 20, and the number of stationary blades in the second row of stationary blades 13 may range from 10 to 30. For example, the number of stationary blades in the first row of stationary blades 12 may be 6, 7, 8, 9, 10, 11, 12, 13, 14, 15, 16, 17, 18, 19 or 20, the number of stationary blades in the second row of stationary blades 13 may be 10, 11, 12, 13, 14, 15, 16, 17, 18, 19, 20, 21, 22, 23, 24, 25, 26, 27, 28, 29 or 30. The number of stationary blades in the first row of stationary blades 12 is in a range from 6 to 20, and the number of stationary blades in the second row of stationary blades 13 is in a range from 10 to 30, such that the airflow can be more fully drained and diffused through the second row of stationary blades of stationary blades 13 when the airflow flows from the first row of stationary blades 12 to the second row of stationary blades of stationary blades 13, to further reduce the flow rate and increase the pressure, and thus the diffusion effect of the diffuser 10 can be also improved.

In this embodiment, the first row of stationary blades 12 and the second row of stationary blades of stationary blades 13 are not in a one-to-one correspondence, or in a strict N-to-one relationship. In this embodiment, the number of the second row of stationary blades of stationary blades 13 is determined first, meanwhile, one end of a certain stationary blade 114 in the second row of stationary blades 13 is positioned aligning with one end of a certain stationary blade 114 in the first row of stationary blades 12, and then the second row of stationary blades of stationary blades 13 is uniformly distribute on the outer ring wall of the base ring member 11. The first row of stationary blades 12 is arranged after the arrangement of the second row of stationary blades of stationary blades 13 is completed.

In this embodiment, as shown in FIG. 4, a distance (shown as D in FIG. 4) along the axial direction of the base ring member 11 between the head of each stationary blade in the first row of stationary blades 12 and the tail of each stationary blade in the second row of stationary blades 13 may be smaller than or equal to 3 mm. For example, the distance along the axial direction of the base ring member 11 between the head of each stationary blade in the first row of stationary blades 12 and the tail of each stationary blade in the second row of stationary blades 13 is defined to be smaller than or equal to 3 mm, which on the one hand, ensures a smooth connection of the first row of stationary blades 12 and the second row of stationary blades of stationary blades 13 for the airflow diversion thereby ensuring the flow efficiency of the airflow, and on the other hand, reserves sufficient assembly clearance for the first and second rows of stationary blades 12, 13 to avoid mutual interference between the first row of stationary blades 12 and the second row of stationary blades of stationary blades 13 caused by the machining dimension error of the first and second rows of stationary blades 12, 13.

Optionally, the distance along the axial direction of the base ring member 11 between the head of each stationary blade in the first row of stationary blades 12 and the tail of each stationary blade in the second row of stationary blades 13 may be greater than or equal to 1 mm and smaller than or equal to 3 mm, such that an optimal balance between ensuring the flow efficiency and avoiding the mutual interference of the first row of stationary blades 12 and the second row of stationary blades of stationary blades 13 can be obtained, so that the optimum diversion and diffusion effect can be achieved for the airflow passing through the first and second rows of stationary blades 12, 13 on the premise of avoiding the mutual interference between the first and second rows of stationary blades, 12 13.

In this embodiment, the outlet placement angle may include a first outlet placement angle located at a blade root of the stationary blade 114 and a second outlet placement angle located at a blade tip of the stationary blade 114. A difference between the angle values of the first outlet placement angle and the second outlet placement angles may ranges from 0° to 20°.

In this way, when the difference between the angle values of the first outlet placement angle and the second outlet placement angle is not 0°, a contour line of the stationary blade 114 along the radial direction of the base ring member 11 will be a curve indicating that the stationary blade 114 is bent in the radial direction of the base ring member 11. When the difference between the two angle values is 0°, it is indicated that the stationary blade 114 extends straight along the radial direction of the base ring member 11, and the angle value of the outlet placement angle is constant along the radial direction.

For example, the difference between the angle values of the first outlet placement angle and the second outlet placement angle may be 0°, 1°, 2°, 3°, 4°, 5°, 6°, 7°, 8°, 9°, 10°, 11°, 12°, 13°, 14°, 15°, 16°, 17°, 18°, 19° or 20°.

The difference between the angle value of the outlet placement angle of the stationary blade 114 close to the outer ring wall 111 of the base ring member 11 and the angle value of the outlet placement angle close to a blade tip surface of the stationary blade 114 is in a range from 0° to 20°, such that the non-uniformity of the airflow at the tail of the stationary blade 114 is further suppressed, and thus the effective diversion of the airflow by the stationary blades 114 is further ensured.

In this embodiment, as shown in FIG. 2, the stationary blade 114 may be an arc-shaped blade. For example, by arranging the stationary blades 114 to be arc-shaped blades, the stationary blades 114 have a smoother and more evenness diversion curve, thereby ensuring that the airflow can flow through the stationary blades 114 more smoothly and stably.

In this embodiment, as shown in FIG. 1, a top surface of each stationary blade 114 of the diffuser 10 is in contact with the inner side wall of the fan cover 21. For example, the top surface of each stationary blade 114 is arranged abutting against the inner side wall of the fan cover 21, such that each stationary blade 114 can fully occupy the area enclosed between the base ring member 11 and the fan cover 21, thereby realizing a sufficient diversion effect for the airflow entering the air supply device 20, and thus achieving sufficient diffusion and deceleration of the airflow.

Based on the above parameter settings, the diffuser 10 may have several specific configurations. In this embodiment, the first row of stationary blades 12 may have an inlet placement angle of 15° and an outlet placement angle of 24°, the second row of stationary blades 13 may have an inlet placement angle of 35° and an outlet placement angle of 75°, and the axial distance between the tail of the first row of stationary blades 12 and the corresponding head of the second row of stationary blades 13 may be 1.8 mm A good aerodynamic performance can be achieved when the diffuser 10 is configured according to the above parameters, and the overall efficiency of the air supply device 20 having the above-mentioned diffuser is about 54% under the measurement condition of the 13 mm orifice plate according to the IEC60312 standard.

In this embodiment, the first row of stationary blades 12 may have an inlet placement angle of 20° and an outlet placement angle of 27°, the second row of stationary blades 13 may have an inlet placement angle of 42° and an outlet placement angle of 60°, and the axial distance between the tail of the first row of stationary blades 12 and the corresponding head of the second row of stationary blades 13 may be 1.3 mm A good aerodynamic performance can be achieved when the diffuser 10 is configured according to the above parameters, and the overall efficiency of the air supply device 20 having the above-mentioned diffuser is about 54.2% under the measurement condition of the 13 mm orifice plate according to the IEC60312 standard.

This embodiment also provides an air supply device 20, which includes the above-mentioned diffuser 10. For example, the air supply device 20 includes a fan cover 21, a drive mechanism 22, an impeller 23 and a diffuser 10. The drive mechanism 22 is arranged in the fan cover 21. The impeller 23 and the drive mechanism 22 are connected and arranged corresponding to an air inlet 24 of the fan cover 21. The diffuser 10 is fixed in the fan cover 21 and located on a side of the impeller 23 away from the air inlet 24.

For example, the drive mechanism 22 includes a frame 221, a motor 222 and a circuit substrate 223. The frame 221 and the circuit substrate 223 are both fixed in the fan cover 21. The motor 222 is arranged on the frame 221, and a drive shaft 224 of the motor 222 passes through the frame 221 and the diffuser 10 and is connected to the impeller 23 so as to drive the impeller 23 to rotate.

The air supply device provided in this embodiment includes the above-mentioned diffuser. The above-mentioned diffuser can ensure a smooth deceleration and diffusion when the airflow flows through the diffuser on the premise of no large flow loss, such that the overall working efficiency of the air supply device can also be improved, thereby saving the working energy consumption of the air supply device.

This embodiment also provides a vacuum cleaning equipment, including the above-mentioned air supply device. The vacuum cleaning equipment provided in this embodiment includes the above-mentioned air supply device, and the above-mentioned air supply device can achieve a smooth deceleration and diffusion of the airflow, save energy and protect environment during operation, such that the vacuuming effect of the vacuum cleaning equipment including the air supply device can be significantly improved, and also the working energy consumption of the vacuum cleaning equipment can be saved.

Figure 6:
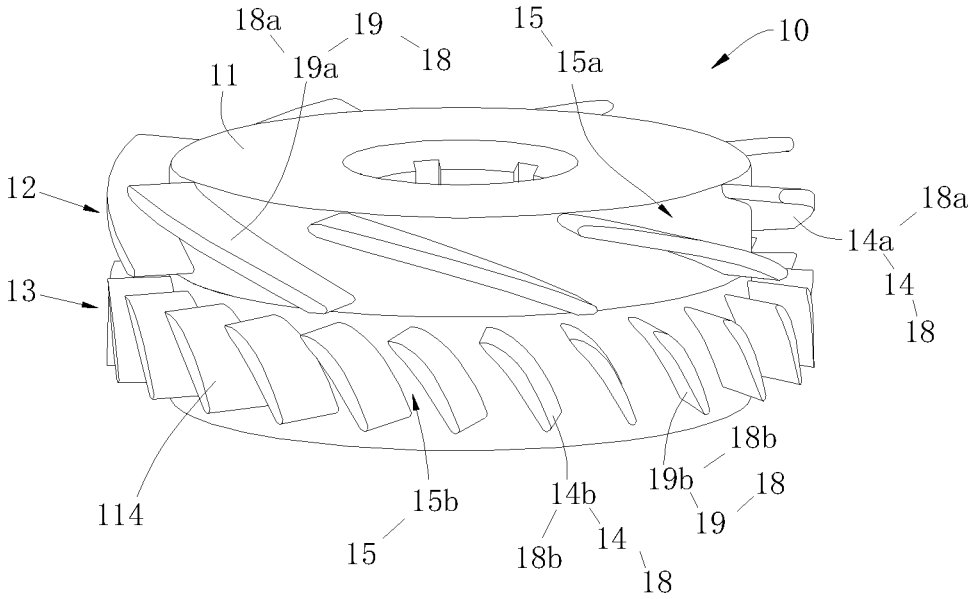
FIG. 6 is a schematic three-dimensional structure diagram of a diffuser in accordance with an embodiment of the present application.
Figure 7:
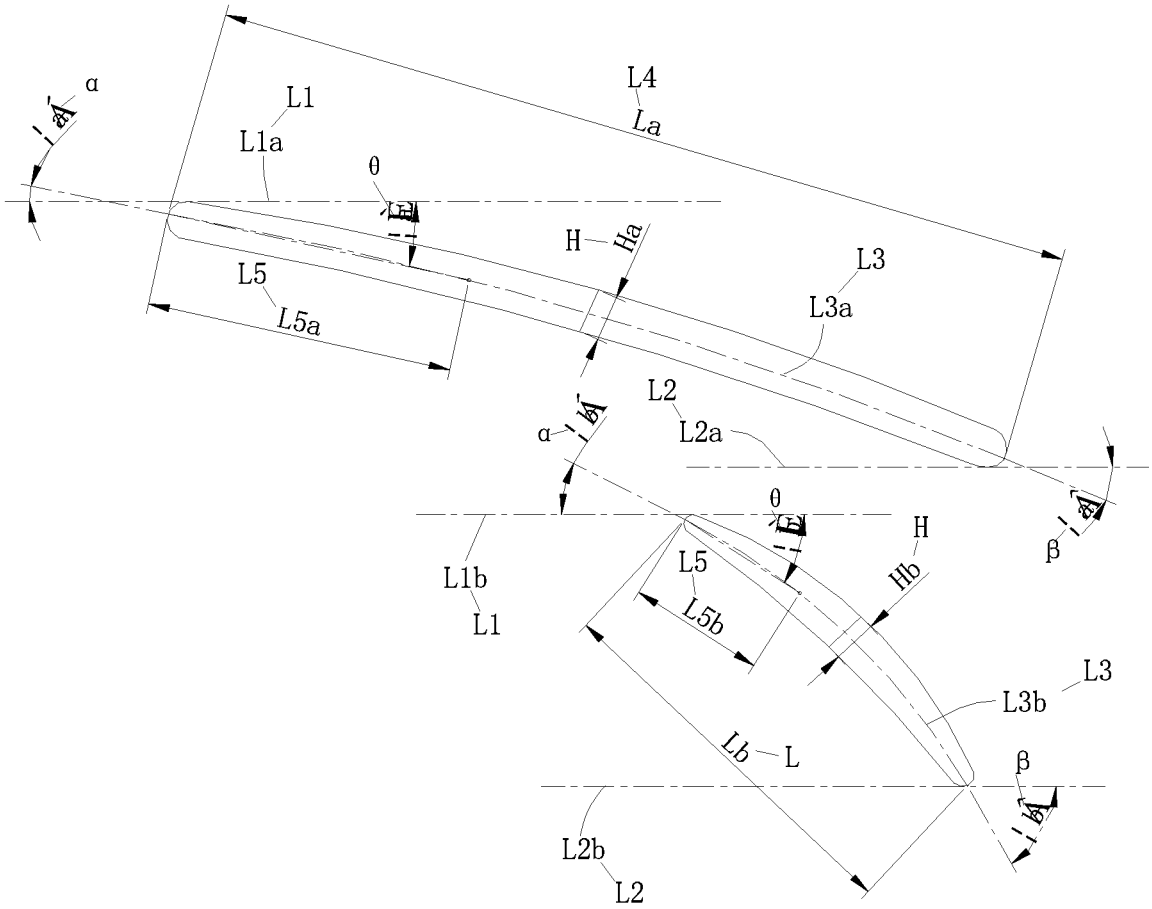
FIG. 7 is a schematic plan view of the cascade of the diffuser of FIG. 6.

Referring to FIGS. 6 and 7, the diffuser 10 according to another exemplary embodiment will now be described. The diffuser 10 includes a base ring member 11 and a plurality of stationary blades 114, and the plurality of stationary blades 114 are arranged in multiple rows. The multiple rows of stationary blades 114 are arranged along the axial direction of the base ring member 11, and the number of the stationary blades 114 in each row of the stationary blades 114 is multiple. The multiple stationary blades 114 in each row of the stationary blades 114 are arranged along the circumferential direction of the base ring member 11, such that a flow channel 15 for guiding airflow can be formed between two adjacent stationary blades 114. The airflow, when flows through the flow channel 15 between the two adjacent stationary blades 114 on the peripheral side of the base ring member 11, is guided by the stationary blades 114, such that the airflow will be more stable, thereby reducing eddy currents and energy loss. The cross-section of the base ring member 11 is circular, so that when the airflow is changed from rotation around the radial direction of base ring member 11 to flowing in the axial direction of base ring member 11, the airflow flows to the peripheral side of base ring 11 at a similar distance, and hence the resistance is also similar. In this way, the airflow can flow more smoothly to the peripheral side of the base ring member 11 and thus the energy loss is reduced. The plurality of stationary blades 114 are arranged in multiple rows along the axial direction of the base ring member 11, such that the airflow can be gradually guided through the multiple rows of stationary blades 114, thereby reducing energy loss and improving the effect of diffusion.

For the convenience of description, it is defined that when the air flows through the diffuser 10, the orientation of the air inlet is up, front or head, and the orientation of the air outlet is down, rear or tail.

For the convenience of description, it is defined that when the plurality of stationary blades 114 are divided into two rows along the axial direction of the base ring member 11, a first row of stationary blades 12 and a second row of stationary blades 13 from top to bottom, namely, the first row of stationary blades 12 is a previous row with respect to the second row of stationary blades 13, and the second row of stationary blades 13 is a next row with respect to the first row of stationary blades 12; and when the plurality of stationary blades 114 are divided into three rows along the axial direction of the base ring member 11, namely, a first row of stationary blades 12, a second row of stationary blades 13 and a third row of stationary blades 114 in sequence from top to bottom. The plurality of stationary blades 114 may also be divided into four or more rows along the axial direction of the base ring member 11, then from top to bottom, it is the first row of stationary blades 12, the second row of stationary blades 13, the third row of stationary blades 114 . . . . That is, when the plurality of stationary blades 114 are arranged in N (N is a positive integer, N≥2) rows along the axial direction of the base ring member 11, then it is sequentially divided into the first row, the second row, . . . and the N-th row from top to bottom. In which, the M-1-th row of stationary blades 114 is the previous row with respect to the M-th row of stationary blades 114, the M-th row of stationary blades 114 is the next row with respect to the M-1-th row of stationary blades 114 (M is a positive integer, M≤N).

Figure 11:
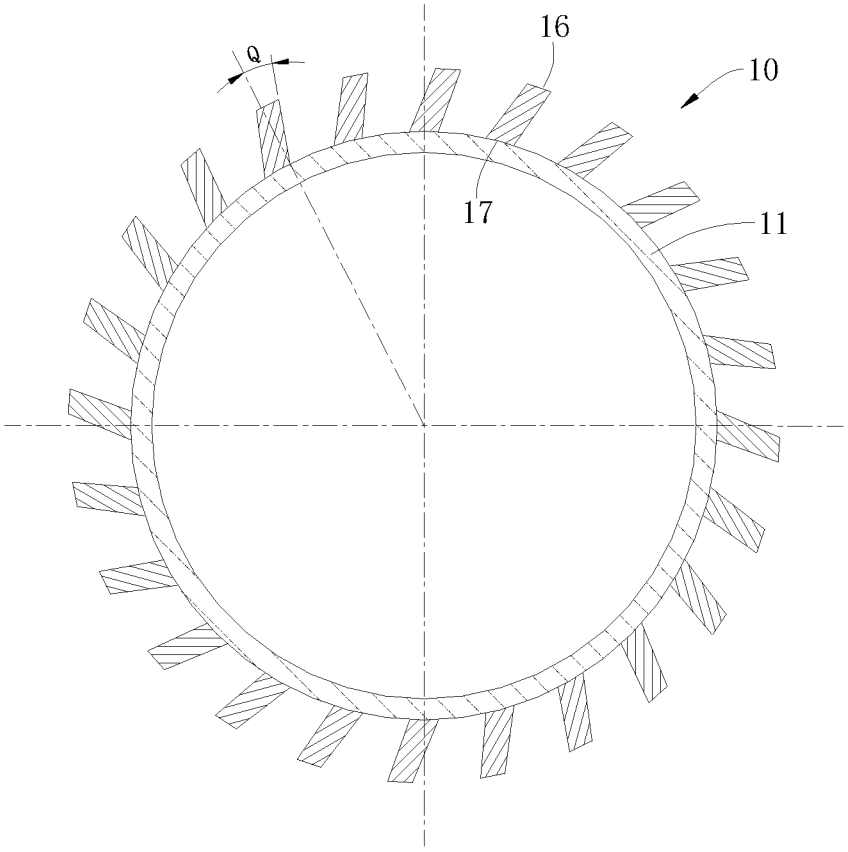
FIG. 11 is a schematic cross-sectional structure diagram along line A-A shown in FIG. 8.

With reference to FIG. 11, profiles 18 of the stationary blade 114 refer to two side surfaces between the blade root 17 and the blade tip 16 of the stationary blade 114. The two sides between the blade root 17 and the blade tip 16 of the stationary blade 114 may respectively be a suction surface 19 and a pressure surface 14, which are collectively referred to as the profiles 18. The blade root 17 of the stationary blade 114 refers to a root position of the stationary blade 114 close to the base ring member 11 in height. The blade tip 16 of the stationary blade 114 refers to a top position of the stationary blade 114 away from the base ring member 11 in height. The head of the stationary blade 114 refers to a position at a front end of the stationary blade 114 along the flow direction of the airflow, that is, the position on the stationary blade 114 that begins to contact the airflow. The tail of the stationary blade 114 refers to a position at the rear end of the stationary blade 114 along the flow direction of the airflow, that is, the position on the corresponding stationary blade 114 where the airflow leaves the stationary blade 114.

Referring to FIG. 6, in the first row of stationary blades 12: the two sides of each stationary blade 114 are respectively the suction surface 19*a* and the pressure surface 14*a*, and the suction surface 19*a* and the pressure surface 14*a* are collectively referred to as the profiles 18*a* of the stationary blade 114. A flow channel 15*a* for guiding the airflow may be formed between two adjacent stationary blades 114. In the second row of stationary blades 13: the two sides of each stationary blade 114 are the suction surface 19*b* and the pressure surface 14*b* respectively, the suction surface 19*b* and the pressure surface 14*b* are collectively referred to as the profiles 18*b* of the stationary blade 114. A flow channel 15*b* for guiding the airflow may be formed between two adjacent stationary blades 114.

In this embodiment, referring to FIG. 6, the plurality of stationary blades 114 may be divided into two rows along the axial direction of the base ring member 11. The first row of stationary blades 12 is the previous row with respect to the second row of stationary blades 13, and the second row of stationary blades 13 is the next row with respect to the first row of stationary blades 12. In some embodiments, the plurality of stationary blades 114 are divided into three, four or more rows along the axial direction of the base ring member 11.

In this embodiment, referring to FIG. 7, by cutting the stationary blade 114 from the middle in height direction, a curved surface is obtained having a height same as the unit thickness of the base ring member 11, the curved surface is cylindrical, and the curved surface is coaxial with the base ring member 11. The curved surface is plane developed to obtain the plane cascade diagram of each stationary blade 114. In the plane cascade diagram, a line connecting corresponding points at the heads of the stationary blades 114 in one row is called the forehead line L1 of this row of stationary blades 114, and meanwhile the forehead line L1 is also a tangent line of a corresponding point at the head of each stationary blade 114 in this row of stationary blades 114. A line connecting corresponding points at the tails of stationary blades 114 in one row is called the posterior forehead line L2 of this row of stationary blades 114, and meanwhile the posterior forehead line L2 is also a tangent line of a corresponding point at the tail of each stationary blade 114 in this row of stationary blades 114. A curve formed by connecting the center points in thickness H of the stationary blade 114 is called the center-line L3 of the stationary blade 114. An included angle between the tangent line of the center-line L3 at the head of the stationary blade 114 and the tangent line of the corresponding point at the head of the stationary blade 114 is the inlet placement angle α, that is, the included angle between the tangent line of the center-line L3 at the head of the stationary blade 114 and the corresponding forehead line L1 is the inlet placement angle α. An included angle between the tangent line of the center-line at the head of the stationary blade 114 and the tangent line of the corresponding point at the tail is the outlet placement angle β, that is, the included angle between the tangent line of the center-line L3 at the tail of the stationary blade 114 and the corresponding posterior forehead line L2 is the outlet placement angle β. A length of the center-line L3 between the head and tail of the stationary blade 114 is the chord length L4, and a straight-line distance from the head of the stationary blade 114 to different positions on the center-line L3 is a position chord length L5, that is, the straight-line distance between each point on the center-line L3 and the head of the stationary blade 114 is the position chord length L5. The position chord length L5 of a certain position of the stationary blade 114 has the installation angle θ, and the installation angle θ of the position chord length L5 is an included angle between the line segment connecting the point at this position and the corresponding point of the same height at the head of the stationary blade 114 and the corresponding forehead line L1.

Taking the first row of stationary blades 12 as an example: the line connecting the corresponding points at the heads of stationary blades 114 in the first row of stationary blades 12 is the forehead line L1a of the first row of stationary blades 12, and meanwhile, the forehead line L1a is the tangent line of the corresponding point at the head of each stationary blade 114 in the first row of stationary blades 12. The line connecting the corresponding points at the tails of the stationary blades 114 in the first row of stationary blades 12 is the posterior forehead line L2a of the first row of stationary blades 12, and meanwhile, the posterior forehead line L2a is the tangent line of the corresponding point at the tail of each stationary blade 114 in the first row of stationary blades 12. The curve formed by connecting the center points in thickness Ha of one stationary blade 114 in the first row of stationary blades 12 is the center-line L3a of this stationary blade 114. The included angle between the tangent line of the center-line L3a of one stationary blade 114 in the first row of stationary blades 12 at the head of this stationary blade 114 and the tangent line of the corresponding point at the head of this stationary blade 114 is the inlet placement angle αa. The included angle between the tangent line of the center-line L3a of one stationary blade 114 in the first row 12 at the rear of this stationary blade 114 and the tangent of the corresponding point at the rear of this stationary blade 114 is the outlet placement angle βa. The length of the center-line L3a of one stationary blade 114 in the first row 12 between the head and the tail of this stationary blade 114 is the chord length La of this stationary blade 114. The straight-line distance from a point on the center-line L3a of one stationary blade 114 in the first row of stationary blades 12 to the head of this stationary blade 114 is the position chord length L5a of the corresponding point on this stationary blade 114. The position chord length L5a of a certain position of each stationary blade 114 in the first row 12 has the installation angle θa, and the installation angle θa of the position chord length L5a is the included angle between the line segment connecting the point at this position and the corresponding point of the same height at the head of the stationary blade 114 and the corresponding forehead line L1a.

Taking the second row of stationary blades 13 as an example: the line connecting the corresponding points at the heads of stationary blades 114 in the second row of stationary blades 13 is the forehead line L1b of the first row of stationary blades 12, and meanwhile, the forehead line L1b is the tangent line of the corresponding point at the head of each stationary blade 114 in the second row of stationary blades 13. The line connecting the corresponding points at the tails of the stationary blades 114 in the second row of stationary blades 13 is the posterior forehead line L2b of the first row of stationary blades 12, and meanwhile, the posterior forehead line L2b is the tangent line of the corresponding point at the tail of each stationary blade 114 in the second row of stationary blades 13. The curve formed by connecting the center points in thickness Hb of one stationary blade 114 in the second row of stationary blades 13 is the center-line L3b of this stationary blade 114. The included angle between the tangent line of the center-line L3b of one stationary blade 114 in the second row of stationary blades 13 at the head of this stationary blade 114 and the tangent line of the corresponding point at the head of this stationary blade 114 is the inlet placement angle αb. The included angle between the tangent line of the center-line L3b of one stationary blade 114 in the second row 13 at the rear of this stationary blade 114 and the tangent of the corresponding point at the rear of this stationary blade 114 is the outlet placement angle βb. The length of the center-line L3b of one stationary blade 114 in the second row of stationary blades 13 between the head and the tail of this stationary blade 114 is the chord length Lb of this stationary blade 114. The straight-line distance from a point on the center-line L3b of one stationary blade 114 in the second row of stationary blades 13 to the head of this stationary blade 114 is the position chord length L5b of the corresponding point on this stationary blade 114. The position chord length L5b of a certain position of each stationary blade 114 in the second row 13 has the installation angle θb, and the installation angle θb of the position chord length L5a is the included angle between the line segment connecting the point at this position and the corresponding point of the same height at the head of the stationary blade 114 and the corresponding forehead line L1b.

In this embodiment, referring to FIGS. 6 and 7, in the multiple rows of stationary blades 114, the thickness H of each stationary blade 114 in at least one row of stationary blades 114 may be in a non-constant setting from the head to the tail of the stationary blade 114, so that when the airflow enters the flow channel 15 between two adjacent stationary blades 114 in this row of stationary blades 114, the flow separation is improved and the flow loss is reduced; when the airflow flows through the flow channels 15 between the stationary blades 114 in this row of stationary blades 114, the eddy current can be improved, and the flow separation at the blade root 17 can be regulated; and when the airflow flows out of the flow channel 15 between the stationary blades 114 in this row of stationary blades 114, the non-uniformity of the airflow can be reduced, the diffusion effect can be improved, and the aerodynamic noise can be reduced.

In the diffuser 10 of this embodiment, multiple rows of stationary blades 114 are arranged in the circumferential direction of the base ring member 11, so that the airflow is gradually guided through the multiple rows of stationary blades 114, and the absolute velocity of the airflow is reduced to improve the diffusion effect. The thickness H of each stationary blade 114 in at least one row of stationary blade 114 is set non-constantly from the head to the tail of the stationary blade 114, so that when the airflow enters the flow channel 15 between two adjacent stationary blades 114 in this row of stationary blade 114, the flow separation can be improved, and the flow loss can be reduced; when the airflow flows through the flow channel 15 between the stationary blades 114 in this row of stationary blades 114, the eddy current can be improved, and the flow separation at the blade root 17 can be regulated; and when the airflow flows out of the flow channels 15 between the stationary blades 114 in this row of stationary blades 114, the non-uniformity of the airflow can be reduced, the diffusion effect can be improved, and the aerodynamic noise can be reduced.

In this embodiment, the length direction of each stationary blade 114 is inclined with respect to the axial direction of the base ring member 11, and the length direction of each stationary blade 114 refers to the direction in which the head and tail of the stationary blade 114 are connected. When the airflow flowing through each flow channel 15 formed between two stationary blades 114, the airflow direction can be gradually guided to reduce the airflow energy loss.

In this embodiment, when multiple rows of stationary blades 114 are included in the diffuser 10, the thickness H of each stationary blade 114 in one of the multiple rows of stationary blades 114 may be set non-constantly from the head to the tail of the stationary blade 114. It should be noted that the thickness H of each stationary blade 114 in more than one of the multiple rows of stationary blades 114 may also be set non-constantly from the head to the tail of the stationary blade 114. The thickness H of each stationary blade 114 in each of the multiple rows of stationary blades 114 may all be set non-constantly from the head to the tail of the stationary blade 114.

In this embodiment, for each stationary blade 114 having a non-constant thickness H, the thickness H of each stationary blade 114 increases first and then gradually decreases from the head to the tail of the stationary blade 114, so that the airflow flows through the flow channels 15 between the stationary blades 114, the circumferential speed and absolute speed of the airflow are first gradually reduced to reduce the flow separation loss; then the eddy current is improved to reduce the non-uniformity of the airflow flowing out of the flow channel 15 between the stationary blades 114, thereby reducing the flow separation loss, improving the diffusion effect, and reducing aerodynamic noise.

In this embodiment, referring to FIGS. 6 and 7, for each stationary blade 114 having a non-constant thickness H, the position chord length L5 at the position where the thickness H of each stationary blade 114 is the largest may be 30% to 45% of the chord length L of the stationary blade 114, that is, each point on the center-line of each stationary blade 114 corresponds to a thickness H, and the position chord length L5 at the point on the center-line corresponding to the maximum thickness H may be 30% to 45% of the chord length L of the stationary blade 114, so that the airflow can be gradually guided after the circumferential velocity and absolute velocity of the airflow are firstly reduced by the stationary blades 114, and thus the flow uniformity of the airflow is improved, the flow separation loss is reduced, the diffusion effect is improved, and aerodynamic noise is reduced.

Taking the first row of stationary blades 12 as an example: when the thickness Ha of each stationary blade 114 in the first row of stationary blades 12 is set non-constantly, each position on the center-line of each stationary blade 114 in this row corresponds to a thickness Ha, and the position chord length L5a at the point corresponding to the maximum thickness Ha is 30% to 45% of the chord length La of the stationary blade 114.

Taking the second row of stationary blades 13 as an example: when the thickness Hb of each stationary blade 114 in the second row of stationary blades 13 is set non-constantly, each position on the center-line of each stationary blade 114 in this row corresponds to a thickness Hb, and the position chord length L5b at the point corresponding to the maximum thickness Hb is 30% to 45% of the chord length Lb of the stationary blade 114.

In this embodiment, referring to FIGS. 6 and 7, for each stationary blade 114 having a non-constant thickness H: the position chord length L5 at the position where the thickness H of each stationary blade 114 is the largest may be 35% to 40% of the chord length L of the stationary blade 114, that is, each point on the center-line of each stationary blade 114 corresponds to a thickness H, and the position chord length L5 at the point on the center-line corresponding to the maximum thickness H may be 30% to 45% of the chord length L of the stationary blade 114, so as to reduce flow separation loss, improve eddy current, improve diffuser effect, and reduce aerodynamic noise.

In this embodiment, referring to FIGS. 6 and 7, in order to better reduce the flow separation loss, improve the eddy current, improve the diffusion effect, and reduce aerodynamic noise, the thickness Hb of each stationary blade 114 in the second row of stationary blades 13 satisfies the following relationship, that is, the thickness Hb corresponding to each point on the center-line of each stationary blade 114 in the second row of stationary blades 13 satisfies the following relationships.

The thickness at the head of each stationary blade 114 ranges from 0.1 to 0.8 mm.

The thickness Hb at a point where the position chord length L5b of each stationary blade 114 is 40% of the chord length Lb of the stationary blade 114, ranges from 1.1 to 1.4 mm.

The thickness at the tail of each stationary blade 114 ranges from 0.1 to 1 mm.

In this embodiment, referring to FIGS. 6 and 7, in order to better determine the thickness at each point of the stationary blades 114, and thereby reducing the flow separation loss, improving the eddy current, improving the diffusion effect, and reducing the aerodynamic noise, the thickness Hb of each stationary blade 114 in the second row of stationary blades 13 satisfies the following relationship, that is, the thickness Hb corresponding to each point on the center-line of each stationary blade 114 in the second row of stationary blades 13 satisfies the following relationships.

The thickness at the head of each stationary blade 114 ranges from 0.1 to 0.8 mm.

The thickness Hb at a point where the position chord length L5b of each stationary blade 114 is 30% of the chord length Lb of the stationary blade 114, ranges from 1 to 1.3 mm.

The thickness Hb at a point where the position chord length L5b of each stationary blade 114 is 40% of the chord length Lb of the stationary blade 114, ranges from 1.1 to 1.4 mm.

The thickness Hb at a point where the position chord length L5b of each stationary blade 114 is 50% of the chord length Lb of the stationary blade 114, ranges from 1 to 1.3 mm.

The thickness Hb at a point where the position chord length L5b of each stationary blade 114 is 60% of the chord length Lb of the stationary blade 114, ranges from 0.9 to 1.2 mm.

The thickness Hb at a point where the position chord length L5b of each stationary blade 114 is 70% of the chord length Lb of the stationary blade 114, ranges from 0.8 to 1.1 mm.

The thickness at the tail of each stationary blade 114 ranges from 0.1 to 1 mm.

In this embodiment, referring to FIGS. 6 and 7, the thickness Hb corresponding to each point on the center-line of each stationary blade 114 in the second row of stationary blades 13 satisfies the following formulas:

$$T2 \leq Hb \leq T1;$$

$$T1 = 0.82 + 0.68L1b - 0.17L1b^2 + 0.011L1b^3; \text{ and}$$

$$T2 = 0.68L1b - 0.17L1b^2 + 0.011L1b^3.$$

In which, L1b is the distance from the corresponding point on the center-line of the stationary blade 114 to the head of the stationary blade 114, that is, L1b is the position chord length of the corresponding point on the center-line of the stationary blade 114; $L1b^2$ is the square of L1b, and $L1b^3$ is the cube of L1b; 0.68 L1b is 0.68 multiplied by L1b; 0.17 $L1b^2$ is 0.17 multiplied by $L1b^2$; 0.011 $L1b^3$ is 0.011 multiplied by $L1b^3$; T1 is the maximum thickness relational formula at the corresponding point on the center-line of the stationary blade 114; and T2 is the minimum thickness relational formula at the corresponding point on the center-line of the stationary blade 114.

The thickness Hb corresponding to each point on the center-line of each stationary blade 114 in the second row of stationary blades 13 is determined by the above formulas, which can better reduce the flow loss, improve the non-uniformity of the airflow, improve the eddy current, improve the diffusion effect, and reduce the aerodynamic noise.

In this embodiment, referring to FIG. 7, in order to better determine the thickness at each point of each stationary blades 114 in the second row of stationary blades 13, and to better reduce the flow loss, improve the non-uniformity of the airflow, improve the eddy current, improve the diffusion effect, and reduce the aerodynamic noise, the thickness Hb corresponding to each point on the center-line of each stationary blade 114 may satisfy the following formula: $Hb=0.32+0.68\ L1b-0.17\ L1b^2+0.011\ L1b^3$. In which, L1b is the distance from the corresponding point on the center-line of the stationary blade 114 to the head of the stationary blade 114, that is, L1b is the position chord length of the corresponding point on the center-line of the stationary blade 114; $L1b^2$ is the square of L1b; $L1b^3$ is the cube of L1b; 0.68 L1b is 0.68 multiplied by L1b; 0.17 $L1b^2$ is 0.17 multiplied by $L1b^2$; 0.011 $L1b^3$ is 0.011 multiplied by $L1b^3$.

Figure 8:
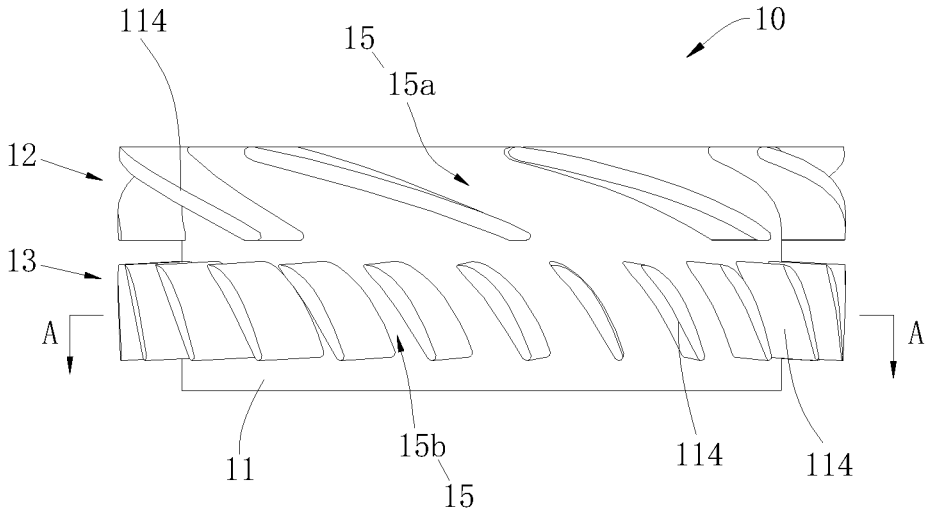
FIG. 8 is a schematic front view showing the structure of the diffuser of FIG. 6.

In this embodiment, referring to FIGS. 6 and 8, an outer diameter of the base ring member 11 ranges from 35 to 80 mm Thus, the thickness H of the stationary blades 114 is better matched with the base ring member 11, the size of the flow channel 15 between the adjacent stationary blades 114 is ensured, the resistance to the airflow is reduced, the energy loss is reduced, and the diffusion effect is improved.

Figure 12:
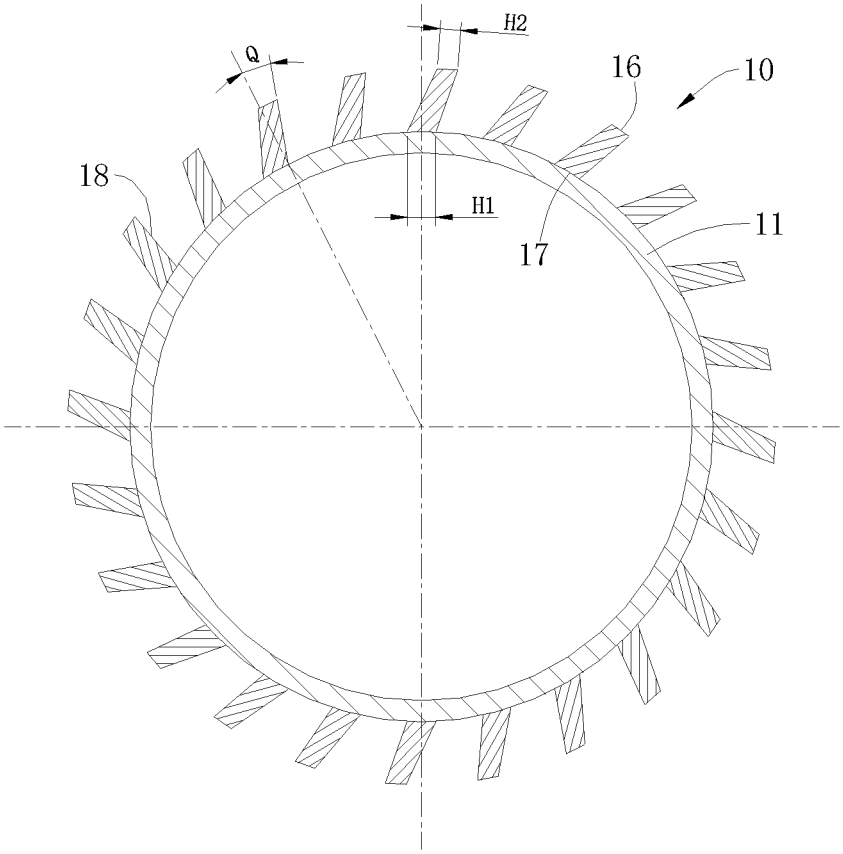
FIG. 12 is a schematic cross-sectional structure diagram of the base ring member and a row of stationary blades along a radial plane of the base ring member of the diffuser in accordance with an embodiment of the present application.

In this embodiment, referring to FIG. 12, for each stationary blade 114 having a non-constant thickness H, the thickness at the blade root 17 corresponding to a position on the center-line of each stationary blade 114 is H1, the thickness at the blade tip 16 corresponding to this position is H2, and $H1 \geq H2$. That is, for any position on the center-line of each stationary blade 114, the thickness H1 at the blade root 17 corresponding to this position is greater than or equal to the thickness H2 at the blade tip 16 corresponding to this position, so that the flow separation near the blade root 17 can be better regulated, thereby reducing the flow separation loss, and improving the diffusion effect.

In this embodiment, referring to FIG. 12, for each stationary blade 114 having a non-constant thickness H, the following relation may be satisfied: $0 \leq H1-H2 \leq 0.5$ mm That is, at any position of each stationary blade 114 the thickness at the blade root 17 is thicker than that at the blade tip 16 by smaller than or equal to 0.5 mm, which is convenient for processing and manufacturing, and ensures the strength of the blade tip 16 of each stationary blade 114 at each position, meanwhile, the flow separation near the blade root 17 is regulated, the flow separation loss can is reduced, and the diffusion effect is improved.

In this embodiment, referring to FIG. 12, for each stationary blade 114 having a non-constant thickness H, the thickness H of each stationary blade 114 at each point on the center-line of each stationary blade 114 is gradually increased from the blade root 17 to the blade tip 16 of the stationary blade 114, so as to better regulate the flow separation near the blade root 17, reduce the flow separation loss, and improve the diffusion effect.

When the diffuser 10 is in use, the airflow flows radially and circumferentially at high speed from the outlet of the impeller, and turns into the diffuser 10 axially at a noticeably short distance from the fan cover, so the flow separation at the outlet of the impeller is serious.

In this embodiment, the installation angle θ of each stationary blade 114 is gradually increased from the head to the tail of the stationary blade 114, so as to gradually reduce the circumferential speed and absolute speed of the airflow, thereby improving the deceleration and diffusion effect. Meanwhile, the profiles 18 of the stationary blades 114 are arranged to have an inclination, which can further reduce the eddy current of the flow channels 15, reduce the energy loss, and improve the diffusion effect.

In this embodiment, the installation angle θ of the position chord length L5 at different positions of the stationary blade 114 may be changed as follows: the installation angle θ at the first half of the stationary blade 114, is basically equal to the inlet placement angle α, so that the area of each flow channel 15 between the stationary blades 114 in the first half of the stationary blade 114 is increased uniformly to achieve uniform reduction of the absolute velocity of the airflow and diffusion effect. The installation angle θ at the second half of the stationary blade 114 is increased from the inlet installation angle α to the outlet installation angle β, so as to reduce the circumferential speed and absolute speed of the airflow, and to further improve the deceleration and diffusion effect.

In this embodiment, referring to FIG. 7, the inlet placement angle αa of each stationary blade 114 in the first row of stationary blades 12 ranges from 5° to 10°. The inlet placement angle αa of each stationary blade 114 in the first row of stationary blades 12 is in a range from 5° to 10°, so that the airflow having high circumferential velocity at the inlet of the stationary blade 114 can be better matched, and thus the absolute velocity of the airflow can be uniformly reduced and the diffusion effect can be improved.

In this embodiment, referring to FIG. 7, the inlet placement angle αb of each stationary blade 114 in the second row of stationary blades 13 ranges from 20° to 60°, The inlet placement angle αa of each stationary blade 114 in the second row 13 is in a range from 20° to 60°, so that the airflow having high circumferential velocity at the inlet of the stationary blade 114 can be better matched, and thus the absolute velocity of the airflow can be uniformly reduced and the diffusion effect can be improved.

In this embodiment, the inlet placement angle αa of each stationary blade 114 in the first row of stationary blades 12 is in the range of 5° to 10°; and the inlet placement angle αb of each stationary blade 114 in the second row of stationary blades 13 is in the range of 20° to 60°. Thus, the circumferential speed and absolute velocity can be gradually reduced as the airflow flowing through the first row of stationary blades 12 to the second row of stationary blades 13, the non-uniformity of the airflow at the tail of the first row of stationary blades 12 can be reduced, the flow loss can be reduced, and thus the diffusion effect can be improved.

In this embodiment, the outlet placement angle βa of each stationary blade 114 in the first row of stationary blades 12 ranges from 10° to 20°. Since the airflow angle distribution is more uneven when the airflow flows out from the tail of the stationary blades 114, the outlet placement angle βa is in a range from 10° to 20°. Thus, the non-uniformity of the outlet flow at the tail of the stationary blade 114 can be further suppressed, the energy loss can be reduced and thus the deceleration and diffusion effect can be improved.

In this embodiment, the inlet placement angle αa of each stationary blade 114 in the first row of stationary blades 12 ranges from 10° to 20°; and the inlet placement angle αb of each stationary blade 114 in the second row of stationary blades 13 ranges from 20° to 60°. Thus, the circumferential speed and absolute velocity can be gradually reduced as the airflow flowing through the first row of stationary blades 12 to the second row of stationary blades 13, the non-uniformity of the airflow at the tail of the first row of stationary blades 12 can be reduced, the flow loss can be reduced, and thus the diffusion effect can be improved.

In this embodiment, the angle range of the outlet placement angle βb of each stationary blade 114 in the second row of stationary blades 13 may be 50° to 90°. Since the airflow angle distribution is more uneven when the airflow flows out from the tail of the stationary blades 114, the outlet placement angle βb is arranged to be in a range from 50° to 90°, such that the non-uniformity of the outlet flow at the tail of the stationary blade 114 can be further suppressed, the energy loss can be reduced and thus the deceleration and diffusion effect can be improved.

In this embodiment, the inlet placement angle αa of each stationary blade 114 in the first row of stationary blades 12 ranges from 10° to 20°; and the inlet placement angle αb of each stationary blade 114 in the second row of stationary blades 13 ranges from 50° to 90°. Thus, the circumferential speed and absolute speed can be gradually reduced when the airflow flows through the first row of stationary blades 12 to the second row of stationary blades 13, and the non-uniformity of the airflow at the tail of the first row of stationary blades 12 can be reduced, thereby the diffusion effect can be improved.

In this embodiment, in the second row of the stationary blades 13, the outlet placement angle βb of each stationary blade 114 ranges from 60° to 90°, and the inlet placement angle αb of each stationary blade 114 ranges from 25° to 50°, so as to better suppress the non-uniformity of the flow at the tail end of the stationary blade 114, reduce the energy loss and improve the deceleration and diffusion effect.

In this embodiment, a variation range of the inlet placement angle α of each stationary blade 114 along the radial direction of the base ring member 11 is smaller than or equal to 10°. That is, the inlet placement angle α of each stationary blade 114 varies from the blade root 17 to the blade tip 16 by smaller than or equal to 10°, and the inlet placement angle α at the blade root 17 of each stationary blade 114 is greater than or equal to the inlet placement angle α at the blade tip 16 of this stationary blade 114, which, on the one hand, is convenient for processing, and on the other hand, can reduce the loss of flow separation and improve the effect of diffuser.

In this embodiment, referring to FIGS. 6 and 8, in two adjacent rows of stationary blades 114, the number of stationary blades 114 in the next row is 1.5 to 3 times of the number of stationary blades 114 in the previous row. The number of stationary blades 114 in the previous row is relatively small, while the number of stationary blades 114 in the next row is set to be larger, so that the airflow can be gradually guided when flowing through each row of stationary blades 114 in sequence, and thus the airflow can be decelerated and the diffusion effect can be improved.

In this embodiment, referring to FIGS. 6 and 8, in two adjacent rows of stationary blades 114, the tail of one stationary blade 114 in the previous row deviates from the head of the corresponding stationary blade 114 in the adjacent next row along the circumferential direction of the base ring member 11 is smaller than or equal to 20°. That is, an included angle between the plane passing through the blade root 17 at the tail of each stationary blade 114 in the previous row and the axis of the base ring member 11 and the plane passing through the blade root 17 at the head of the corresponding stationary blade 114 in the next row and the axis of the base ring member 11, is smaller than or equal to 20°, so as to reduce the non-uniformity of the airflow, reduce the loss of flow separation, and improve the diffusion effect.

Figure 14:
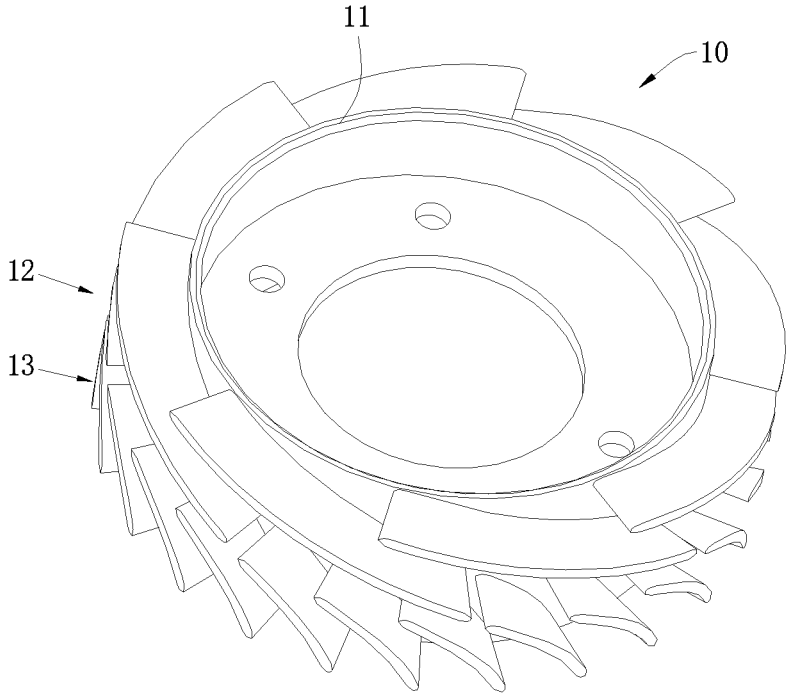
FIG. 14 is a schematic three-dimensional structure diagram of a diffuser in accordance with an embodiment of the present application.

In this embodiment, referring to FIG. 14, in two adjacent rows of stationary blades 114, the tail of one stationary blade 114 in the previous row is aligned with the head of the corresponding stationary blade 114 in the adjacent next row, so as to reduce the non-uniformity of airflow, reduce the loss of flow separation, and improve the diffusion effect.

Figure 9:
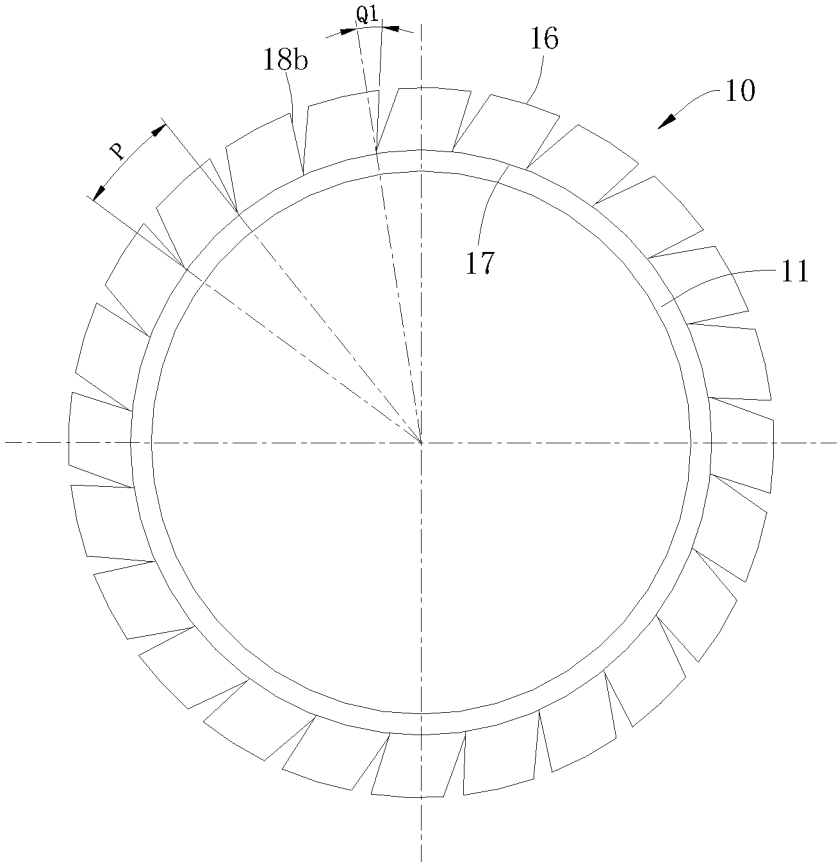
FIG. 9 is a schematic top view of the base ring member and the second row of stationary blades of the diffuser shown in FIG. 8.
Figure 10:
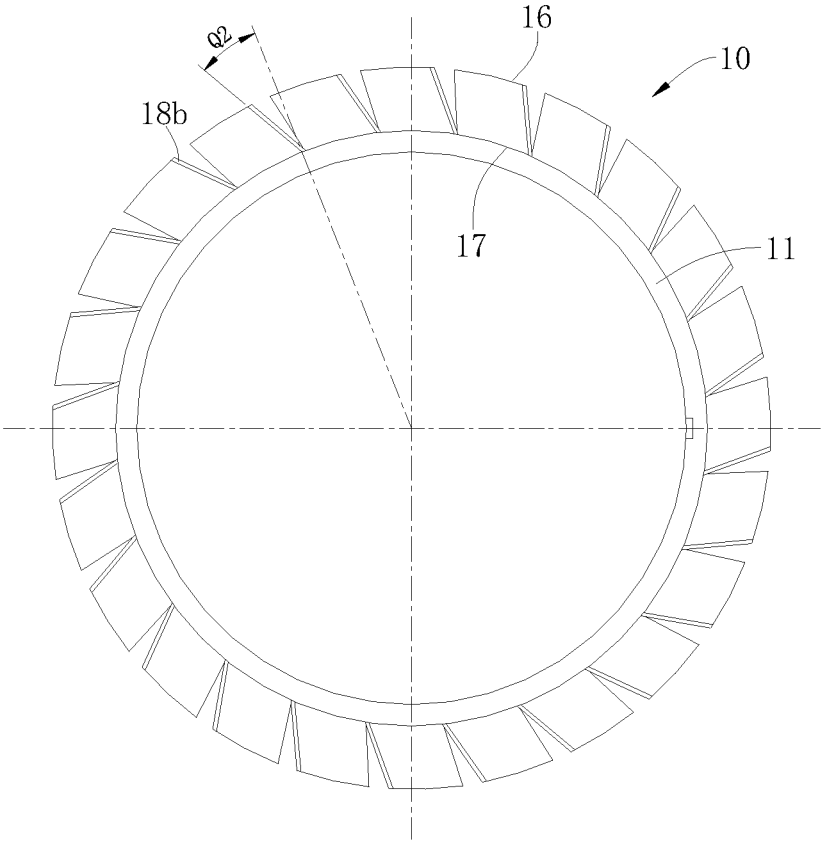
FIG. 10 is a schematic bottom view of the base ring member and the second row of stationary blades in the diffuser shown in FIG. 8.

In this embodiment, referring to FIGS. 9, 10 and 11, the inclination angle Q of the profile 18 at a certain point on the stationary blade 114 may refer to an included angle between the line segment where the profile 18 of the stationary blade 114 intersects the radial surface of the base ring member 11 passing through the point on the stationary blade 114 and the radial line passing through the point on the stationary blade 114.

In this embodiment, the radial surface of the base ring member 11 refers to a plane perpendicular to the axial direction of the base ring member 11. The radial line is the radial line of the base ring member 11, and the radial line of the base ring member 11 refers to a straight line extending radially along the base ring member 11. The radial line passing through this point on the stationary blade 114 refers to a straight line extending radially along the base ring member 11 and passing through this point.

In this embodiment, for each stationary blade 114 having inclined profiles 18, the inclination angle of the profile 18 at the tail of each stationary blade 114 is greater than or equal to the inclination angle of the profile 18 at head of this stationary blade 114. The inclination angle of the profile 18 at the tail is arranged to be greater than or equal to the inclination angle of the profile 18 at the head of each stationary blade 114, so that the stationary blades 114 can gradually strengthen the guidance and adjustment of the airflow when the airflow flows through the flow channels 15 between the stationary blades 114, the eddy current of the flow channel 15*b* can be improved, and thus the separation loss, the airflow energy loss and the noise can be reduced.

In this embodiment, for each stationary blade 114 having inclined profiles 18: the inclination angle of the profile 18 of each stationary blade 114 is gradually increased from the head to the tail of the stationary blade 114, so that the airflow, when flowing through the flow channels 15 between the stationary blades 114, can be gradually adjusted to improve the airflow separation loss, reduce energy loss, and reduce noise.

In this embodiment, referring to FIGS. 9 and 10, in the second row of stationary blades 13, the inclination angle of profile 18*b* at the head of each stationary blade 114 is Q1, and the inclination angle of the profile 18*b* at tail of each stationary blade 114 is Q2, and Q2≥Q1. The inclination angle Q2 of the profile 18*b* at the tail of each stationary blade 114 in the second row of stationary blades 13 is set to be greater than or equal to the inclination angle Q1 of the profile 18*b*, so that the stationary blades 114 can gradually strengthen the guidance and adjustment of the airflow when the airflow flows through the flow channels 15*b* between the stationary blades 114, to improve the eddy current of the flow channel 15*b*, reduce the separation loss, and then reduce the airflow energy loss and noise.

In this embodiment, referring to FIGS. 9 and 10, in the second row of stationary blades 13: the value range of Q1 may be 0° to 30°, that is, the inclination angle Q1 of the profile 18*b* at the head of each stationary blade 114 may be smaller than or equal to 30°, so that when the airflow enters the flow channels 15*b* between the stationary blades 114, it is possible to prevent the airflow rotation angle from being over-adjusted, which will result in a large energy loss. The value range of Q2 may be 0° to 40°, that is, the inclination angle Q2 of the profile 18*b* at the tail of each stationary blade 114 is smaller than or equal to 40°, so that when the airflow enters the flow channels 15*b* between the stationary blades 114, it is possible to prevent the airflow rotation angle from being over-adjusted, which will result in a large energy loss.

In this embodiment, referring to FIGS. 9 and 10, in the second row of stationary blades 13, the value range of Q1 may be 12° to 18°, so that the flow separation loss and noise can be better reduced when the airflow enters the flow channels 15*b* between the stationary blades 114. The value range of Q2 may be 20° to 35°, and Q2≥Q1. Thus, the flow separation loss, the energy loss and the aerodynamic noise are better reduced when the airflow flows through the flow channels 15*b* between the stationary blades 114.

In this embodiment, in the second row of stationary blades 13, the value of Q1 ranges from 0° to 30°, so as to prevent the airflow angle from being over-adjusted when the airflow enters the flow channels 15*b* between the stationary blades 114, that may result in a larger energy loss. The value of Q2 ranges from 15° to 40°, so as to avoid excessive adjustment of the airflow when the airflow flows through the flow channel 15*b* between the stationary blades 114, resulting in a large energy loss.

In this embodiment, referring to FIG. 9, an included angle between the plane passing through the blade root 17 at the head of each stationary blade 114 and the axis of the base ring member 11 and the plane passing through the blade root 17 at the tail of this stationary blade 114 and the axis of the base ring member 11 is a wrap angle P of this stationary blade 114.

In this embodiment, referring to FIG. 9, in two adjacent rows of stationary blades 114, the wrap angle of each stationary blade 114 in the previous row is greater than or equal to the wrap angle of each stationary blade 114 in the next row. The wrap angle of each stationary blade 114 in the previous row is arranged to be larger so as to better guide the airflow gradually, reduce the separation loss, and improve the diffusion effect.

In this embodiment, referring to FIG. 7, in two adjacent rows of stationary blades 114, the chord length Lb of each stationary blades 114 in the previous row is greater than or equal to that in the next row. Since the airflow has a larger circumferential velocity when entering the diffuser 10, the chord length Lb of each stationary blade 114 in the previous row of stationary blades 114 is arranged to be longer, so that the airflow when flowing through each row of stationary blades 114, can be better guided, the circumferential speed of the airflow can be reduced, and also the airflow through each row of stationary blades 114 can be gradually guided, thereby reducing separation loss.

Figure 13:
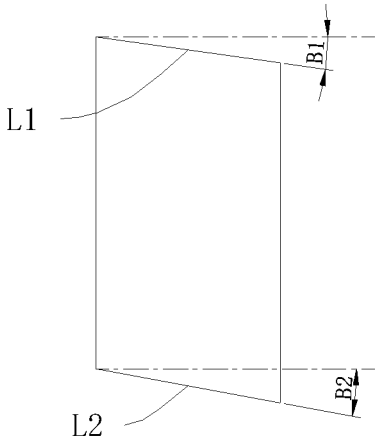
FIG. 13 is a schematic diagram of a stationary blade on a meridian projection plane in the diffuser in accordance with an embodiment of the present application.

In this embodiment, referring to FIG. 13, the plane passing through the axial direction of the base ring member 11 is the meridian plane of the diffuser 10. The projection of each stationary blade 114 on the meridian plane along the circumferential direction of the base ring member 11 is the meridional projection plane of this stationary blade 114. A leading-edge line 214 of each stationary blade 114 is a line segment projected from the head of the stationary blade 114 onto the meridian plane. A trailing-edge line 215 of each stationary blade 114 is a line segment projected from the tail of the stationary blade 114 onto the meridian plane. The intersection line of the radial plane of the base ring member 11 and the meridional projection plane is a line segment perpendicular to the axial direction of the base ring member 11.

In this embodiment, in at least one row of the stationary blades 114, the leading-edge line 214 of each stationary blade 114 is inclined to the radial surface of the base ring member 11. That is, the line segment of the leading-edge line 214 of each stationary blade 114 in this row on the meridional projection plane is inclined to the radial direction of the base ring member 11, thereby the flow separation loss can be reduced and the diffusion effect can be improved.

In this embodiment, when multiple rows of stationary blades 114 are included in the diffuser 10, the leading-edge line 214 of each stationary blade 114 in one of the multiple rows of the stationary blades 114 may be inclined to the radial surface of the base ring member 11. It should be noted that the leading-edge line 214 of each stationary blade 114 in more than one of the multiple rows of stationary blades 114 may also be inclined to the radial surface of the base ring member 11. The leading-edge line 214 of each stationary blade 114 in each of the multiple rows of stationary blades 114 may all be inclined to the radial surface of the base ring member 11.

In this embodiment, referring to FIG. 13, in the second row of stationary blades 13, the absolute value of an inclination angle B1 between the leading-edge line 214 of each of the stationary blades 114 and the radial surface of the base ring member 11 is smaller than or equal to 25°. The absolute value of the inclination angle B1 between the leading-edge line 214 of each stationary blade 114 in the second row of stationary blades 13 and the radial surface of the base ring member 11 is arranged to be smaller than or equal to 25°, so as to better reduce the flow separation loss and improve the diffusion effect.

In this embodiment, referring to FIG. 13, in the second row of stationary blades 13, the leading-edge line 214 of each stationary blade 114 is inclined toward the tail of the stationary blade 114, so as to further regulate the flow separation near the blade root 17, reduce flow separation loss and improve diffusion effect.

In this embodiment, in at least one row of the stationary blades 114, the trailing-edge line 215 of each stationary blade 114 is inclined to the radial surface of the base ring member 11. That is, the line segment of the trailing-edge line 215 of each stationary blade 114 in this row on the meridional projection plane is inclined to the radial direction of the base ring member 11. Thus, the non-uniformity of the airflow at the outlet of the stationary blades 114 can be reduced, and the diffusion effect can be improved.

In this embodiment, when multiple rows of stationary blades 114 are included in the diffuser 10, the trailing-edge line 215 of each stationary blade 114 in one of the multiple rows of the stationary blades 114 may be inclined to the radial surface of the base ring member 11. It should be noted that the trailing-edge line 215 of each stationary blade 114 in more than one of the multiple rows of stationary blades 114 may also be inclined to the radial surface of the base ring member 11. The trailing-edge line 215 of each stationary blade 114 in each of the multiple rows of stationary blades 114 may all be inclined to the radial surface of the base ring member 11.

In this embodiment, referring to FIG. 13, in the second row of stationary blades 13, the absolute value of the inclination angle B2 between the trailing-edge line 215 of each stationary blades 114 and the radial surface of the base ring member 11 is smaller than or equal to 30°. The absolute value of the inclination angle B2 between the trailing-edge line 215 of each stationary blade 114 in the second row of stationary blades 13 and the radial surface of the base ring member 11 is smaller than or equal to 30°, so as to better improve the flow uniformity at the outlet of the stationary blades 114 and improve the diffusion effect.

In this embodiment, the diffuser 10 further includes a casing (not shown), the base ring member 11 is placed in the casing, and each stationary blade 114 is located between the base ring member 11 and the casing. The casing is provided, which can not only protect the stationary blades 114, but also form a channel between the base ring member 11 and the casing, so as to better define the passages for airflow and ensure that the diffuser 10 has consistent performance in different air supply devices.

In this embodiment, at least 80% of the top surface of each stationary blade 114 is in contact with the inner surface of the casing, that is, at least 80% of the area of the blade tip 16 of each stationary blade 114 is in contact with the inner surface of the casing, so as to better define the flow channel 15 for airflow through each stationary blade 114, the base ring member 11 and the casing, and to better guide the airflow, thereby improving the diffusing effect.

In this embodiment, the casing, the base ring member 11 and the stationary blades 114 are integrally formed to ensure a good connection between the casing and the stationary blades 114, and also increase the strength of the diffuser 10.

In this embodiment, the casing may be manufactured separately, and then the base ring member 11 having the stationary blades 114 is placed in the casing.

The diffuser 10 of this embodiment can not only improve the eddy current of the flow channel 15, reduce the separation loss, reduce the energy loss, improve the diffusion effect, but also reduce the aerodynamic noise. The air supply device using the diffuser 10 of this embodiment can not only generate greater suction, but also operate with less noise. The diffuser 10 of this embodiment can be applied not only to an air supply device, but also to electrical appliances such as a vacuum cleaner, a range hood, and an air blower device.

Figure 15:
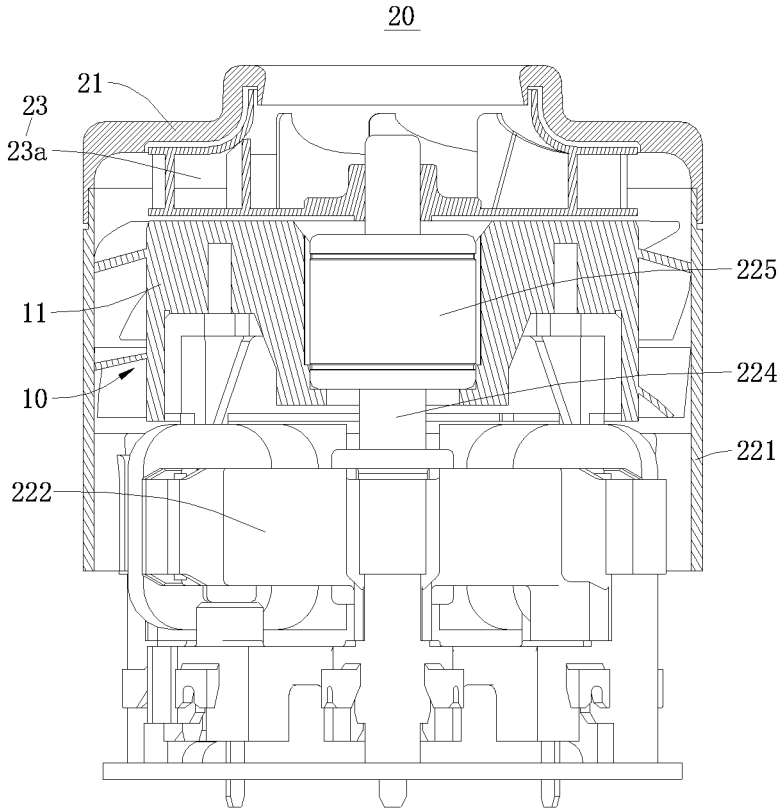
FIG. 15 is a schematic cross-sectional structure diagram of a first type of air supply device in accordance with an embodiment of the present application.

Referring to FIG. 15, this embodiment also provides an air supply device 20, which includes a frame 221, an impeller 31, a fan cover 32, a motor 222 and the diffuser 10 described in any of the above embodiments. The diffuser 10 is installed in the frame 221. The impeller 31 is disposed at a front end of the diffuser 10. The fan cover 32 is covered on the impeller 31, and is installed on the frame 221. The motor 222 is installed on the frame 221, and is connected to the impeller 31. By using the diffuser 10 of the above-mentioned embodiment, the air supply device 20 can reduce energy loss and reduce operating noise, so that a larger suction force can be generated under the same power.

In this embodiment, referring to FIG. 15, a bearing 225 is installed in the base ring member 11, and a drive shaft 224 of the motor 222 is connected to the impeller 31 through the bearing 225, so that the motor 222 can drive the impeller 31 to rotate more flexibly.

In this embodiment, referring to FIG. 15, the impeller 31 is a closed centrifugal impeller 31*a*. In this embodiment, the impeller 31 may also be an open centrifugal impeller. In this embodiment, referring to FIG. 11, the impeller 31 may also be a mixed flow impeller 31*b*.

Figure 16:
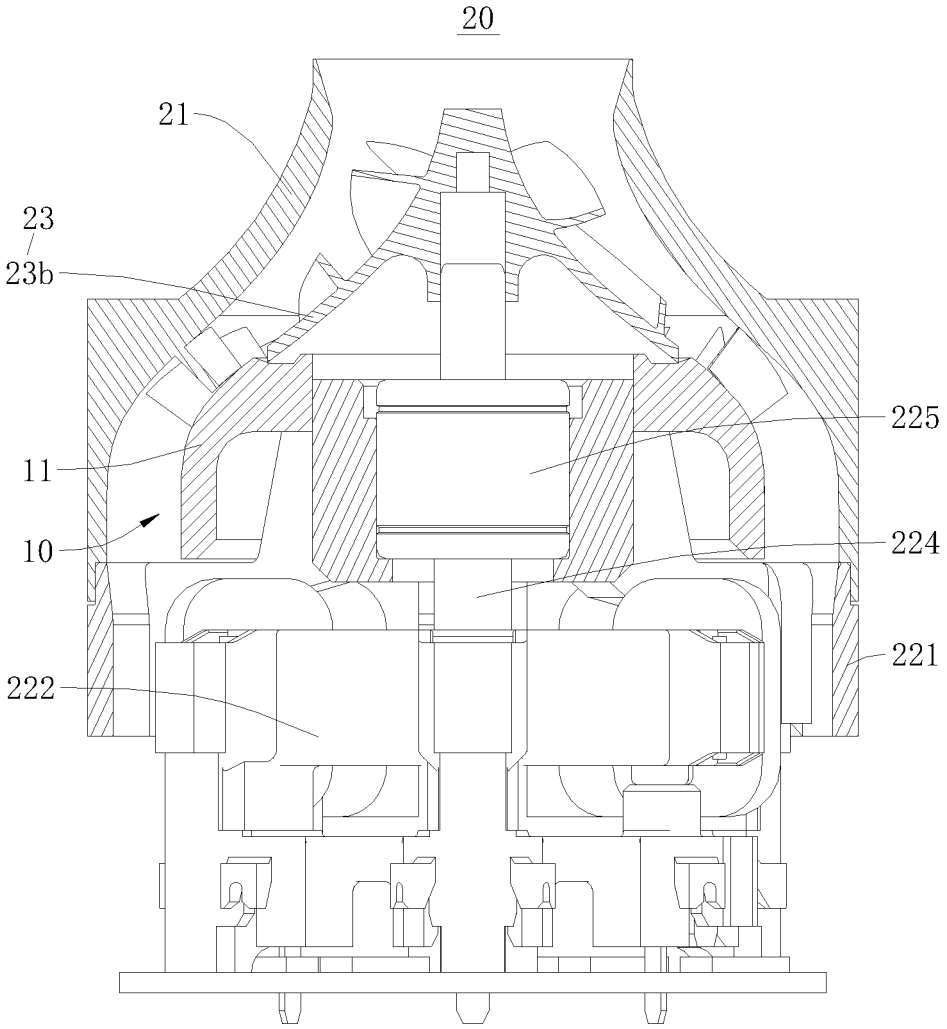
FIG. 16 is a schematic cross-sectional structure diagram of a second type of air supply device in accordance with an embodiment of the present application.

In this embodiment, referring to FIG. 16, the fan cover 32 may extend to the rear of the diffuser 10. That is, the fan cover 32 covers both the impeller 31 and the diffuser 10, so as to better direct the airflow at the outlet of the impeller 31 to diffuser 10.

In this embodiment, the frame 221 can be integrally formed with the fan cover 32 to ensure the connection strength between the frame 221 and the fan cover 32.

The air supply device 20 of this embodiment may be applied to electrical appliances such as vacuum cleaners, range hoods, air blower devices, and fans.

In this embodiment, a vacuum cleaning equipment is also provided, which includes the air supply device 20 described in any of the above embodiments. The vacuum cleaning equipment of this embodiment uses the above-mentioned air supply device 20, which not only has high power and high efficiency, but also has low noise.

As shown in FIGS. 6, 9 and 10, in yet one exemplary embodiment of the disclosure, a diffuser 10 is provided, which is different from the previous embodiment in that the profiles 18 of each stationary blade 114 in at least one of the multiply rows of stationary blades 114 are inclined towards one side of the stationary blade 114. The profiles 18 of the corresponding stationary blade 114 are inclined toward one side of the stationary blade 114, that is, the profiles 18 of this stationary blade 114 are inclined in the radial direction of the base ring member 11, which can effectively improve the separation of boundary layer when the airflow leaving the stationary blades 114, and thus reduce the separation loss, improve the eddy current of the flow channels 15 between the stationary blades 114, thereby the flow loss, the airflow energy loss, and the aerodynamic noise can be further reduced.

In this embodiment, the profiles 18*a* of each stationary blade 114 in the first row of stationary blades 12 may be inclined, so that the absolute velocity of the airflow is reduced when the airflow passes through the first row of stationary blades 12, the separation loss is reduced, and the diffusion effect is improved.

In this embodiment, referring to FIGS. 6 and 8, the profiles 18*b* of each stationary blade 114 in the second row of stationary blades 13 may be inclined, so as to reduce the absolute velocity of the airflow when the airflow passes through the second row of stationary blades 13, reduce the separation loss and improve the diffusion effect.

In this embodiment, the profiles 18 of each stationary blade 114 in the first row of stationary blades 12 and each stationary blade 114 in the second row of stationary blades 13 may all be inclined, so as to better reduce velocity of the airflow, the separation loss, and the non-uniformity of the airflow, thereby improving the diffusion effect.

In this embodiment, when multiple rows of stationary blades 114 are included in the diffuser 10, the profiles 18 of each stationary blade 114 in one of the multiple rows of stationary blades 114 may be inclined. It should be noted that the profiles 18 of each stationary blade 114 in more than one of the multiple rows of stationary blades 114 may also be inclined. The profiles 18 of each stationary blade 114 in each of the multiple rows of stationary blades 114 may all be inclined.

In this embodiment, for each stationary blade 114 having the inclined profiles 18, the profiles 18 of this stationary blade 114 may be inclined toward the side of the suction surface 19 of the stationary blade 114, such that the separation of the boundary layer of the airflow can be better improved, thereby improving the eddy current of the flow channels 15 between the stationary blades 114, reducing the energy loss, and reducing the aerodynamic noise.

In this embodiment, when the profiles 18*a* of each stationary blade 114 in the first row of stationary blades 12 are disposed obliquely, the profiles 18*a* of each stationary blade 114 in the first row of stationary blades 12 are inclined toward the side of the suction surface 19*a* of this stationary blade 114.

In this embodiment, referring to FIGS. 6 and 9, when the profiles 18*b* of each stationary blade 114 in the second row of stationary blades 13 are disposed obliquely, the profiles 18*b* of each stationary blade 114 in the second row of stationary blades 13 are inclined toward the side of the suction surface 19*b* of this stationary blade 114.

In this embodiment, for each stationary blade 114 having the inclined profiles 18, the profiles 18 of this stationary blade 114 may be inclined toward the side of the pressure surface 14 of the stationary blade 114, such that the non-uniformity of airflow can be better improved, thereby improving the eddy current of the flow channels 15 between the stationary blades 114, reducing the energy loss, and reducing the aerodynamic noise.

In this embodiment, when the profiles 18*a* of each stationary blade 114 in the first row of stationary blades 12 are disposed obliquely, the profiles 18*a* of each stationary blade 114 in the first row of stationary blades 12 are inclined toward the side of the pressure surface 14*a* of the stationary blade 114.

In this embodiment, referring to FIGS. 6 and 9, when the profiles 18*b* of each stationary blade 114 in the second row of stationary blades 13 are disposed obliquely, the profiles 18*b* of each stationary blade 114 in the second row of stationary blades 13 are inclined toward the side of the pressure surface 14*b* of the stationary blade 114.

The above are merely some preferred embodiments of the present application and are not intended to limit the present application. Any modifications, equivalent replacements and improvements made within the spirit and principles of the present application shall be included within the protection scope of the present application.

What is claimed is:

1. A diffuser comprising:

a base ring member; and multiple rows of stationary blades, the multiple rows of the stationary blades being disposed on an outer ring wall of the base ring member along an axial direction of the base ring member in sequence and arranged along a circumferential direction of the base ring member, wherein:

opposite sides of the base ring member along the axial direction are an air-inlet side and an air-outlet side respectively, and from the air-inlet side to the air-outlet side, a chord length of each stationary blade in one row is greater than or equal to a chord length of each stationary blade in a next adjacent row;

the multiple rows of stationary blades comprise a first row of stationary blades and a second row of stationary blades, and the first row of stationary blades and the second row of stationary blades are disposed on the outer ring wall of the base ring member along the axial direction of the base ring member in sequence from the air-inlet side to the air-outlet side;

a ratio of the chord length of each stationary blade in the first row to the chord length of each stationary blade in the second row is greater than or equal to 1 and smaller than or equal to 5;

each stationary blade has an installation angle, and from the air-inlet side to the air-outlet side, the installation angle of each stationary blade in one row is smaller than or equal to the installation angle of each stationary blade in the next adjacent row, wherein the installation angle is an included angle between a forehead line and the chord length of each stationary blade and the installation angle varies in accordance with the chord length, and wherein the forehead line is a line formed by connecting corresponding points at heads of the stationary blades in a same row, and wherein each stationary blade is in an arc shape;

the forehead line of the first row of stationary blades is co-planar with a surface of the base ring member facing the air-inlet side of the base ring member;

a head of each stationary blade has an inlet placement angle, and from the air-inlet side to the air-outlet side, the inlet placement angle of each stationary blade in one row is smaller than or equal to the inlet placement angle of each stationary blade in the next adjacent row;

a tail of each stationary blade has an outlet placement angle, and from the air-inlet side to the air-outlet side, the outlet placement angle of each stationary blade in one row is smaller than or equal to the outlet placement angle of each stationary blade in the next adjacent row; and from the air-inlet side to the air-outlet side, the outlet placement angle of each stationary blade in one row is smaller than or equal to the inlet placement angle of each stationary blade in the next adjacent row.

2. The diffuser according to claim 1, wherein an angle value of the inlet placement angle of each stationary blade in the first row in a range from 5° to 20°, and the angle value of the inlet placement angle of each stationary blade in the second row is in a range from 20° to 40°.

3. The diffuser according to claim 1, wherein an angle value of the outlet placement angle of each stationary blade in the first row is in a range from 10° to 60°, and the angle value of the outlet placement angle of each stationary blade in the second row is in a range from 60° to 80°.

4. The diffuser according to claim 1, wherein:

a number of stationary blades in the first row is smaller than or equal to a number of stationary blades in the second row;

the first row of stationary blades and the second row of stationary blades are respectively distributed uniformly along the circumferential direction of the outer ring wall;

the first row of stationary blades and the second row of stationary blades are mutually staggered in the axial direction of the outer ring wall; and at least the head or tail of one stationary blade in the first row is aligned with the head or tail of one stationary blade in the second row in the axial direction of the outer ring wall.

5. The diffuser according to claim 1, wherein a distance along the axial direction of the base ring member between the head of each stationary blade in the first row and the tail of each stationary blade in the second row is smaller than or equal to 3 mm.

6. The diffuser according to claim 1, wherein:

the outlet placement angle comprises a first outlet placement angle at a blade root of the stationary blade and a second outlet placement angle at a blade tip of the stationary blade; and a difference between the angle value of the first outlet placement angle and the angle value of the second outlet placement angle is in a range from 0° to 20°.

7. The diffuser according to claim 1, wherein the head of each stationary blade in the first row of stationary blades is axially aligned with the tail of the adjacent stationary blade in the first row of stationary blades.

8. The diffuser according to claim 1, wherein the surface of the base ring member facing the air-inlet side of the base ring member is perpendicular to the outer ring wall of the base ring.

* * * * *